US008713958B2

(12) United States Patent
Sekine

(10) Patent No.: US 8,713,958 B2
(45) Date of Patent: May 6, 2014

(54) AIR CONDITIONER HAVING INDOOR AND OUTDOOR UNITS

(75) Inventor: Takashi Sekine, Ota (JP)

(73) Assignee: SANYO Electric Co., Ltd., Moriguchi-shi (JP)

( * ) Notice: Subject to any disclaimer, the term of this patent is extended or adjusted under 35 U.S.C. 154(b) by 737 days.

(21) Appl. No.: 12/868,323

(22) Filed: Aug. 25, 2010

(65) Prior Publication Data

US 2011/0048054 A1 Mar. 3, 2011

(30) Foreign Application Priority Data

Aug. 28, 2009 (JP) ..... 2009-198535
Aug. 31, 2009 (JP) ..... 2009-200326

(51) Int. Cl.
*F25B 13/00* (2006.01)
*F25B 7/00* (2006.01)
*F25B 1/10* (2006.01)

(52) U.S. Cl.
USPC ..... 62/324.6; 62/298; 62/299; 62/324.1; 62/335; 62/510

(58) Field of Classification Search
USPC ..... 62/324.1, 324.6, 298, 299
See application file for complete search history.

(56) References Cited

U.S. PATENT DOCUMENTS 5,490,399 A * 2/1996 Sada ..... 62/510
2006/0123834 A1* 6/2006 Hwang et al. ..... 62/470

FOREIGN PATENT DOCUMENTS

JP 06-257889 A 9/1994
JP 2804527 B2 9/1998
JP 2004-020187 A 1/2004

OTHER PUBLICATIONS

Japanese Office Action dated May 28, 2013, issued in corresponding Japanese Patent Application No. 2009-200326 with English translation (4 pages).

* cited by examiner

*Primary Examiner* — Allen Flanigan
*Assistant Examiner* — Antonio R Febles
(74) *Attorney, Agent, or Firm* — Westerman, Hattori, Daniels & Adrian, LLP

(57) ABSTRACT

A triple-pipeline type first outdoor unit 2 provided with a first compressor 20 and a first outdoor heat exchanger 21, a plurality of indoor units 4A to 4D are provided, a second outdoor unit 3 provided with a second compressor 30, a second outdoor heat exchanger 32, and a second expansion valve 33, the first outdoor unit 2 is provided with a first four-way valve 60 that makes a refrigerant discharge pipe 25 of the first compressor 20 and a high-pressure gas pipe 7 capable of communicating with each other and if all the indoor units 4A to 4D perform a cooling operation at the same time, the first four-way valve 60 shuts off the communication between the refrigerant discharge pipe 25 and the high-pressure gas pipe 7, while a third four-way valve 51 is switched so as to connect a gas pipe 35*d* to the high-pressure gas pipe 7.

6 Claims, 12 Drawing Sheets

AIR CONDITIONER HAVING INDOOR AND OUTDOOR UNITS

INCORPORATION BY REFERENCE

The present application claims priority under 35 U.S.C. §119 to Japanese Patent Application No. 2009-198535 filed on Aug. 28, 2009 and Japanese Patent Application No. 2009-200326 filed on Aug. 31, 2009. The content of the applications is incorporated herein by reference in its entirety.

BACKGROUND OF INVENTION

1. Technical Field

The present invention relates to an air conditioner having an outdoor unit and a plurality of indoor units, in which the plurality of indoor units can perform a cooling operation or a heating operation at the same time or the heating operation and the cooling operation can be performed in a mixed manner.

2. Background Art

In general, an air conditioner of a fluid pipe and a gas pipe connection type (hereinafter referred to as a "double pipeline type") is known in which an outdoor unit and a plurality of indoor units are connected through two inter-unit pipelines made up of a fluid pipe and a gas pipe and the plurality of indoor units are made to perform the cooling operation or the heating operation. Also, recently, an air conditioner of a low-pressure gas pipe, a high-pressure gas pipe and a fluid pipe connection type (hereinafter referred to as a "triple pipeline type") is proposed, in which the outdoor unit and the plurality of indoor units are connected through three inter-unit pipelines made up of a low-pressure gas pipe, a high-pressure gas pipe and a fluid pipe and the plurality of indoor units are made to perform the cooling operation or the heating operation at the same time or the cooling operation and the heating operation are performed in a mixed manner (See JP-B-2804527, for example).

In this type of triple-pipeline type air conditioner, if the plurality of indoor units are made to perform the cooling operation and the heating operation in a mixed manner, the three inter-unit pipelines are all used for the operations but if only the cooling operation or the heating operation is performed, two (the fluid pipe and the low-pressure gas pipe in the cooling operation and the fluid pipe and the high-pressure gas pipe for the heating operation) in the three inter-unit pipelines are used.

Here, in the cooling operation, since a low-pressure gas refrigerant evaporated in an indoor heat exchanger of the indoor unit fully flows through the low-pressure gas pipe and is sucked into a compressor of the outdoor unit, a pressure loss can easily occur due to channel resistance in the low-pressure gas pipe. If the pressure loss occurs, a sucking pressure of the compressor is lowered and a specific volume becomes large, and the capacity of the compressor is lowered, and thus, the cooling capacity of the air conditioner is deteriorated, which is a problem. In the meantime, if a pipe diameter of the low-pressure gas pipe is changed and increased, the pressure loss is reduced, and the drop in the sucking pressure of the compressor is suppressed, but a great cost is required.

On the other hand, in the above-mentioned prior-art triple-pipeline type air conditioner, since the outdoor unit is connected to the three inter-unit pipelines, the outdoor unit has more complicated configuration of devices connected by pipelines or routing of the pipelines as compared with the double-pipeline type outdoor unit, which tends to increase the size of the device configuration. Also, since the three inter-unit pipelines need to be provided, a piping cost is high and a piping work becomes complicated, which is a problem.

SUMMARY OF INVENTION

Thus, the present invention has an object to solve the above-mentioned problem and to provide an air conditioner that can suppress a drop in the sucking pressure of a compressor with a simple configuration without changing the three inter-unit pipelines.

In order to achieve the above object, the present invention is, in an air conditioner configured such that a first outdoor unit provided with a first compressor, a first outdoor heat exchanger, and a first outdoor expansion valve and a plurality of indoor units provided with indoor heat exchangers are connected by an inter-unit pipeline, one end of the first outdoor heat exchanger is selectively branched and connected to a refrigerant discharge pipe and a refrigerant sucking pipe of the first compressor, the inter-unit pipeline has a high-pressure gas pipe connected to the refrigerant discharge pipe, a low-pressure gas pipe connected to the refrigerant sucking pipe, and a fluid pipe connected to the other end of the first outdoor heat exchanger, one end of the indoor heat exchanger is selectively branched and connected to the high-pressure gas pipe and the low-pressure gas pipe, and the other end of the indoor heat exchanger is connected to the fluid pipe through a fluid branch pipe so that the plurality of indoor units can perform a cooling operation or a heating operation at the same time or the cooling operation and the heating operation can be performed in a mixed manner, characterized in that a second outdoor unit provided with a second compressor, a second outdoor heat exchanger, and a second expansion valve and connected by two pipelines of a gas pipe and a fluid pipe and a valve-element kit having a channel switching valve that connects the fluid pipe of the second outdoor unit to the fluid pipe of the inter-unit pipeline and selectively connects the gas pipe of the second outdoor unit to the high-pressure gas pipe or the low-pressure gas pipe of the inter-unit pipeline are provided, the first outdoor unit is provided with a valve element that makes the refrigerant discharge pipe and the high-pressure gas pipe capable of communicating with each other, and in a case of the cooling operation of the indoor units at the same time, the valve element shuts off the communication between the refrigerant discharge pipe and the high-pressure gas pipe and the channel switching valve is switched so as to connect the gas pipe to the high-pressure gas pipe.

In this configuration, it may be so configured that the valve element is a single first four-way valve having four ports, in which the refrigerant discharge pipe is connected to a first port of this first four-way valve, the high-pressure gas pipe is connected to a second port, a third port is closed or the low-pressure gas pipe is connected to this third port through a capillary tube, and a fourth port is closed or the low-pressure gas pipe is connected to this fourth port through a capillary tube.

Also, it may be so configured that the first outdoor unit is provided with a second four-way valve between the first compressor and the first outdoor heat exchanger, and the high-pressure gas pipe is connected to a refrigerant discharge branch pipe branching from between this second four-way valve and the first compressor through the valve element, the low-pressure gas pipe is connected to a refrigerant sucking branch pipe branching from between the second four-way valve and the first compressor, and the second four-way valve makes the low-pressure gas pipe communicate with the first outdoor heat exchanger at a first switching position and makes the first compressor communicate with the first outdoor heat exchanger at a second switching position.

Also, it may be so configured that the valve-element kit is provided with a single third four-way valve as the channel switching valve, in which the gas pipe is connected to a first port of this third four-way valve, the low-pressure gas pipe is connected to a second port, the high-pressure gas pipe is connected to a third port, and a fourth port is closed or the low-pressure gas pipe is connected to this fourth port through a capillary tube.

Also, the valve-element kit may be configured to be disposed outside of a housing of the second outdoor unit.

Also, a capacity of the first compressor may be configured to be provided with the capacity of at least a half of all the compressors disposed in the air conditioner.

Also, the present invention has an object to solve the above-mentioned problems and to provide an air conditioner that can make an indoor unit perform a cooling operation and a heating operation in a mixed manner using a double-pipeline type outdoor unit.

In order to achieve the above object, the present invention is characterized by including an outdoor unit provided with a compressor, a four-way valve, and an outdoor heat exchanger, a switching unit connected to two inter-unit pipelines of a gas pipe and a fluid pipe extending from the outdoor unit and provided with a switching valve that selectively branches the gas pipe to a high-pressure gas pipe and a low-pressure gas pipe and connects them and with an auxiliary compressor in which a refrigerant sucking pipe is connected to the low-pressure gas pipe and a refrigerant discharge pipe is connected to the high-pressure gas pipe, and a plurality of indoor units provided with an indoor heat exchanger having one end selectively branched and connected to the high-pressure gas pipe and the low-pressure gas pipe and the other end connected to the fluid pipe through a fluid branching pipe.

In this configuration, it may be so configured that the switching valve is a single four-way valve having four ports, in which the gas pipe is connected to a first port of this four-way valve, the high-pressure gas pipe is connected to a second port, the low-pressure gas pipe is connected to a third port, and the refrigerant sucking pipe is connected to a fourth port through a connection pipe having an opening-degree regulating valve.

Also, the switching unit may be configured to be arranged close to the indoor unit. Also, it may be so configured that a refrigerant sucking branch pipe branching between the auxiliary compressor and the switching valve is connected to the refrigerant sucking pipe of the switching unit and the other end of the refrigerant sucking branch pipe is connected to the fluid pipe through the opening-degree regulating valve.

Also, the auxiliary compressor of the switching unit may be configured to be provided with the capacity of at least a half of the compressor of the outdoor unit.

Also, if the indoor units are operated in a mixed operation of cooling and heating with an emphasis on cooling, the switching valve may be configured to shut off the communication between a refrigerant discharge pipe of the compressor in the outdoor unit and the refrigerant discharge pipe of the auxiliary compressor of the switching unit.

DESCRIPTION OF EMBODIMENTS

First Embodiment

An embodiment of the present invention will be described referring to the attached drawings.

Figure 1:
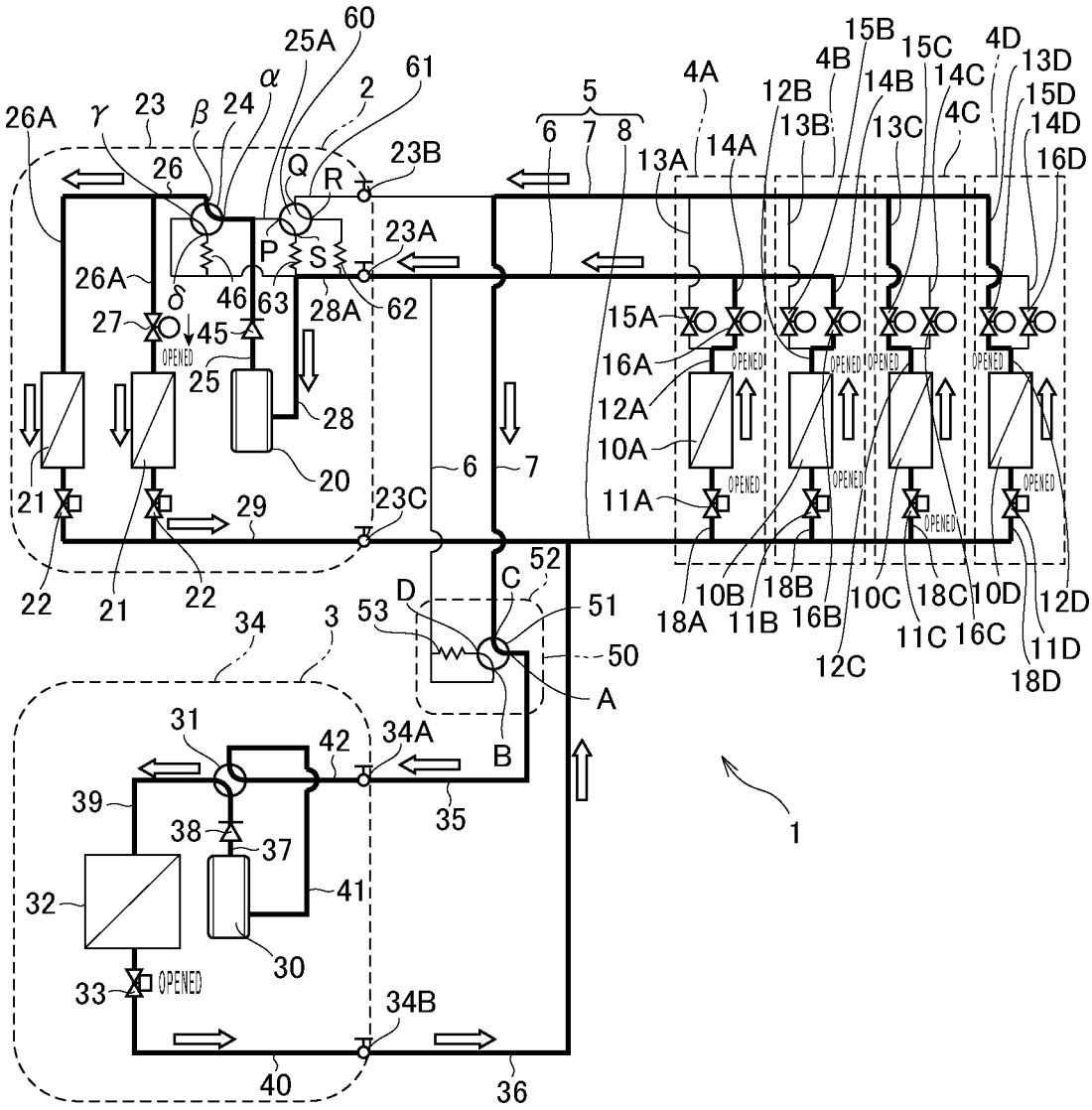
FIG. 1 shows an air conditioner according to a first embodiment of the present invention and is a circuit diagram illustrating a flow of a refrigerant when the air conditioner performs a cooling operation.

FIG. 1 is a circuit diagram illustrating an air conditioner according to a first embodiment. This air conditioner 1 includes a first outdoor unit 2, which is a triple-pipeline type outdoor unit, a second outdoor unit 3, which is a double-pipeline type outdoor unit, and a plurality of (four, for example) indoor units 4A, 4B, 4C, and 4D. An inter-unit pipeline 5 that connect the first outdoor unit 2 and the second outdoor unit 3 to the indoor units 4A to 4D is constituted by a low-pressure gas pipe 6, a high-pressure gas pipe 7, and a fluid pipe 8, and the air conditioner 1 is capable of performing a cooling operation or a heating operation of the indoor units 4A to 4D at the same time or a mixed operation of the cooling operation and the heating operation.

The indoor unit 4A includes an indoor heat exchanger 10A and an indoor expansion valve 11A, and one end of the indoor heat exchanger 10A is connected to the fluid pipe 8 through a fluid branch pipe 18A having the indoor expansion valve 11A disposed. Also, to the other end of the indoor heat exchanger 10A, a branch pipe 12A is connected, and the branch pipe 12A branches to a high-pressure gas branch pipe 13A and a low-pressure gas branch pipe 14A. The high-pressure gas branch pipe 13A is connected to the high-pressure gas pipe 7 through a first opening/closing valve 15A, while the low-pressure gas branch pipe 14A is connected to the low-pressure gas pipe 6 through a second opening/closing valve 16A.

Also, the indoor unit 4A is provided with temperature sensors (not shown) that detect inlet/outlet temperatures of the indoor heat exchanger 10A and a room temperature, pressure sensors (not shown) that detect a refrigerant pressure in the indoor heat exchanger 10A and the like arranged and in addition, an indoor controller (not shown) that receives inputs of detection results of these sensors and executes control of the indoor unit 4A. Since the indoor units 4B to 4D have substantially the same configuration as that of the indoor unit 4A, the same reference numerals are given to the same portions and the description will be omitted.

The first outdoor unit 2 includes a variable-capacity type first compressor (DC inverter compressor) 20, a first four-way valve (valve element) 60 and a second four-way valve 24 connected in parallel with the discharge side of the first compressor 20, a plurality of (2 units in this embodiment) first outdoor heat exchangers 21 and 21 connected to this second four-way valve 24, first expansion valves (first outdoor expansion valves) 22 and 22, and a first unit case (housing) 23 that contains them.

In this first unit case 23, a low-pressure gas pipe service valve 23A, a high-pressure gas pipe service valve 23B, and a first fluid-pipe service valve 23C to which each device in the first unit case 23 as well as the low-pressure gas pipe 6, the high-pressure gas pipe 7, and the fluid pipe 8 of the inter-unit pipeline 5 are connected, respectively, are disposed.

In this configuration, the capacity of the first compressor 20 is set at least at a half of the capacity of all the compressors provided in the air conditioner 1. According to this, if a cooling-heating mixed operation is performed with a load balance of a cooling load and a heating load of 50%:50%, for example, the cooling and heating operations of each of the indoor units 4A to 4D can be performed using only the first outdoor unit 2 provided with the first compressor 20. Also, if the cooling load or the heating load is increased and the load balance is changed to the cooling load and the heating load of 60%:40%, for example, the excess cooling load can be borne by the second outdoor unit 3. Thus, however changed the load balance of the cooling load and the heating load of the indoor units 4A to 4D during the cooling-heating mixed operation is, an air-conditioning operation with the load balance can be realized.

The second four-way valve 24 is provided with four ports, and a refrigerant discharge pipe 25 of the first compressor 20 is connected to a first port α. To this refrigerant discharge pipe 25, one end of a refrigerant discharge branch pipe 25A branching between the first compressor 20 and the second four-way valve 24, while the other end of the refrigerant discharge branch pipe 25A is connected to the first four-way valve 60. Reference numeral 45 denotes a check valve.

Also, to a second port β of the second four-way valve 24, an in-unit gas pipe 26 is connected, and this in-unit gas pipe 26 branches into two pipes of in-unit branch gas pipes 26A and 26A, each of which is connected to one end sides of the first outdoor heat exchangers 21 and 21, respectively. In this configuration, an electromagnetic opening/closing valve (opening/closing valve) 27 is disposed in the in-unit branch gas pipe 26A connected to one of the first outdoor heat exchangers 21 and 21 so that the refrigerant can selectively communicate through the first outdoor heat exchangers 21 and 21.

To the other ends of the first outdoor heat exchangers 21 and 21, in-unit branch fluid pipes 29A and 29A are connected, respectively, and these in-unit branch fluid pipes 29A and 29A merge with each other to form a first in-unit fluid pipe (fluid pipe) 29 and is connected to the fluid pipe 8 of the inter-unit pipeline 5 through a first fluid pipe service valve 23C. Also, on the in-unit branch fluid pipes 29A and 29A, the above-mentioned first expansion valves 22 and 22 are disposed, respectively.

Also, to a third port γ of the second four-way valve 24, a refrigerant sucking pipe 28 of the first compressor 20 is connected. To this refrigerant sucking pipe 28, one end of a refrigerant sucking branch pipe 28A branching between the first compressor 20 and the second four-way valve 24 is connected, while the other end of the refrigerant sucking branch pipe 28A is connected to the low-pressure gas pipe 6 through the low-pressure gas pipe service valve 23A.

Also, to a fourth port δ of the second four-way valve 24, a capillary tube 46 is connected, and the other end of this capillary tube 46 is connected to the refrigerant sucking pipe 28. Here, if the first outdoor unit 2 is stopped, a refrigerant in the refrigerant pipeline (the refrigerant sucking pipe 28 and the in-unit gas pipe 26) in the first outdoor unit 2 might be stopped. Thus, in order to prevent collection of the refrigerant into the refrigerant pipeline, the refrigerant sucking pipe 28 is connected to the fourth port δ through the capillary tube 46. The fourth port δ may be simply closed by a sealing plug or the like without connecting the refrigerant sucking pipe 28 to the fourth port δ through the capillary tube 46.

Also, the first four-way valve 60 has four ports similarly to the second four-way valve 24, and the other end of the refrigerant discharge branch pipe 25A is connected to a first port P. Also, to a second port Q of the first four-way valve 60, one end of the in-unit high-pressure gas pipe 61 is connected, while the other end of this in-unit high-pressure gas pipe 61 is connected to the high-pressure gas pipe 7 through the high-pressure gas pipe service valve 23B.

To a third port R and a fourth port S of the first four-way valve 60, capillary tubes 62 and 63 are connected, respectively, and the other ends of these capillary tubes 62 and 63 are connected to the refrigerant sucking branch pipe 28A. The third port R and the fourth port S may be simply closed by sealing plugs or the like.

In this configuration, the first outdoor unit 2 is made capable of being connected to the three inter-unit pipelines 5 by changing a piping configuration of the so-called double-pipeline type outdoor unit.

Specifically, on the first unit case 23, the high-pressure gas pipe service valve 23B and the first four-way valve 60 are disposed, the high-pressure gas pipe service valve 23B is connected to the second port Q of the first four-way valve 60 by the in-unit high-pressure gas pipe 61, the first port P of the first four-way valve 60 is connected to the refrigerant discharge pipe 25 by the refrigerant discharge branch pipe 25A. Also, the third port R and the fourth port S of the first four-way valve 60 are connected to the refrigerant sucking branch pipe 28A through the capillary tubes 62 and 63, respectively.

Also, in the double-pipeline type outdoor unit, a pipeline that connects the gas pipe service valve (in this configuration, it corresponds to the low-pressure gas pipe service valve 23A) to the four-way valve (in this configuration, it corresponds to the fourth port δ of the second four-way valve 24) is removed, the low-pressure gas pipe service valve 23A and the refrigerant sucking pipe 28 are connected through the refrigerant sucking branch pipe 28A, and the fourth port δ of the second four-way valve 24 is connected to the refrigerant sucking pipe 28 through the capillary tube 46.

As mentioned above, by disposing the first four-way valve 60 in the existing double-pipeline type outdoor unit and by changing a part of the piping configuration, the first outdoor unit 2 that can be connected to the three inter-unit pipelines 5 can be configured easily, and as compared with a case in which the triple-pipeline type outdoor unit is developed independently, a development period can be reduced and a manufacturing line can be made common, whereby a production cost can be reduced. Also, since the first outdoor unit is constituted on the basis of the so-called double-pipeline type outdoor unit, this first outdoor unit 2 has the piping configuration thereof more simplified than the prior-art triple-pipeline type outdoor unit, by which size reduction of the device can be realized.

Also, in the first outdoor unit 2, pressure sensors (not shown) that detect a sucking pressure and a discharge pressure of the first compressor 20 and a refrigerant pressure in each of the first outdoor heat exchangers 21 and 21, temperature sensors (not shown) that detect inlet/outlet temperatures of each of the first outdoor heat exchangers 21 and 21 and an outside temperature and the like are arranged and moreover, a first outdoor controller (not shown) that controls the first outdoor unit 2 by receiving inputs of detection results of these sensors is provided.

The second outdoor unit 3 includes a variable-capacity type second compressor (DC inverter compressor) 30, a four-way valve 31, a second outdoor heat exchanger 32, a second expansion valve (second outdoor expansion valve) 33, and a second unit case 34 that contains them, and in this second unit case 34, a gas-pipe service valve 34A and a second fluid-pipe service valve 34B to which a device in the second unit case 34 and two pipelines of a gas pipe 35 and a fluid pipe 36 are connected, respectively, are disposed.

The second outdoor unit 3 is an existing double-pipeline type (two-way) outdoor unit capable of performing a cooling operation or a heating operation through switching of the four-way valve 31.

A refrigerant discharge pipe 37 of the second compressor 30 is connected to the four-way valve 31 through a check valve 38, and this four-way valve 31 is connected to one end of the second outdoor heat exchanger 32 through an in-unit gas pipe 39. To the other end of this second outdoor heat exchanger 32, a second in-unit fluid pipe 40 is connected, and this second in-unit fluid pipe 40 is connected to the second fluid-pipe service valve 34B through the second expansion valve 33. To the second fluid-pipe service valve 34B, the fluid pipe 36 is connected.

On the other hand, a refrigerant sucking pipe 41 of the second compressor 30 is connected to the four-way valve 31, and to this four-way valve 31, the gas-pipe service valve 34A is connected through an in-unit gas pipe 42. To this gas-pipe service valve 34A, the gas pipe 35 is connected.

Also, in the second outdoor unit 3, pressure sensors (not shown) that detect a sucking pressure and a discharge pressure of the second compressor 30 and a refrigerant pressure in the second outdoor heat exchanger 32, temperature sensors (not shown) that detect inlet/outlet temperatures of the second outdoor heat exchanger 32 and an outside temperature and the like are arranged and moreover, a second outdoor controller (not shown) that controls the second outdoor unit 3 by receiving inputs of detection results of these sensors is provided.

In this embodiment, the first outdoor unit 2 functions as a parent unit, and the first outdoor controller of this first outdoor unit 2 performs operation control of the entire air conditioner 1 by communicating with the second outdoor controller and each indoor controller on the basis of a user instruction inputted through a remote controller, not shown.

Since the second outdoor unit 3 is provided with two pipelines of the gas pipe 35 and the fluid pipe 36 extending from the second unit case 34, the two pipelines cannot be connected to the three inter-unit pipelines 5 as they are. Thus, in this configuration, the air conditioner 1 is provided with a valve-element kit 50 that selectively connects the gas pipe 35 extending from the second outdoor unit 3 to the high-pressure gas pipe 7 or the low-pressure gas pipe 6 of the inter-unit pipeline 5. This valve-element kit 50 includes a single third four-way valve 51 as a channel switching valve and a case body 52 that contains the third four-way valve 51, and in this case body 52, connection ports to which the above-mentioned gas pipe 35, the high-pressure gas pipe 7, and the low-pressure gas pipe 6 are connected, respectively, are formed. Also, the fluid pipe 36 extending from the second unit case 34 is connected to the fluid pipe 8 of the inter-unit pipeline 5.

The valve-element kit 50 is an exclusive kit that connects the second outdoor unit 3, which is an existing double-pipeline type outdoor unit, to the inter-unit pipeline 5, and one unit of the valve-element kit 50 is disposed for one unit of the second outdoor unit 3. According to this, by using the valve-element kit 50, the existing double-pipeline type second outdoor unit 3 can be connected to the inter-unit pipeline 5, and for a part of the outdoor units connected to the triple-pipeline type air conditioner 1, an inexpensive existing double-pipeline type outdoor unit can be employed instead of an expensive triple-pipeline type outdoor unit with a complicated piping configuration, whereby the price of the entire air conditioner 1 can be lowered.

Also, the valve-element kit 50 is arranged outside the second unit case 34 of the second outdoor unit 3. According to this, the existing double-pipeline type second outdoor unit 3 can be used for the triple-pipeline type air conditioner 1 as it is without changing the piping configuration, and the configuration of the air conditioner 1 can be simplified.

On the third four-way valve 51 of the valve-element kit 50, four ports A to D are disposed, in which the gas pipe 35 is connected to a first port A, the low-pressure gas pipe 6 is connected to a second port B, the high-pressure gas pipe 7 is connected to a third port C, and a capillary tube 53 is connected to a fourth port D, and the other end of this capillary tube 53 is connected to the low-pressure gas pipe 6. The fourth port D may be simply closed by a sealing plug or the like without connecting the low-pressure gas pipe 6 to the fourth port D through the capillary tube 53.

The third four-way valve 51 of the valve-element kit 50 has the operation thereof controlled by the second outdoor controller of the second outdoor unit 3.

Subsequently, an operation of this air conditioner 1 will be described.

If all the indoor units 4A to 4D are to perform the cooling operation at the same time, the low-pressure gas pipe 6, the high-pressure gas pipe 7, and the fluid pipe 8 are all used. In this case, as shown in FIG. 1, in the first outdoor unit 2, the second four-way valve 24 is switched to a position (a second switching position) where a discharge refrigerant of the first compressor 20 is led to the first outdoor heat exchangers 21 and 21, that is, a position where the first port $\alpha$ and the second port $\beta$ as well as the third port $\gamma$ and the fourth port $\delta$ of the second four-way valve 24 communicate with each other, and the electromagnetic opening/closing valve 27 and the first expansion valves 22 and 22 are opened. Also, the first four-way valve 60 is switched to a position where the communication between the refrigerant discharge pipe 25 of the first compressor 20 and the high-pressure gas pipe 7 is shut off, that is, the first port P and the fourth port S as well as the second port Q and the third port R of the first four-way valve 60 are made to communicate with each other.

Also, in the second outdoor unit 3, the four-way valve 31 is switched to a position of the cooling operation where the discharge refrigerant of the second compressor 30 is led to the second outdoor heat exchanger 32. Also, in the indoor units 4A and 4B, the first opening/closing valves 15A and 15B are closed, and the second opening/closing valves 16A and 16B are opened, while in the indoor units 4C and 4D, the first opening/closing valves 15C and 15D are opened, and the second opening/closing valves 16C and 16D are closed. In the valve-element kit 50, the third four-way valve 51 is switched to a position where the first port A and the third port C as well as the second port B and the fourth port D are made to communicate with each other.

As a result, the refrigerant discharged from the first compressor 20 flows sequentially to the refrigerant discharge pipe 25, the second four-way valve 24, the in-unit gas pipe 26, and the first outdoor heat exchangers 21 and 21, is condensed and liquefied in the first outdoor heat exchangers 21 and 21, and then, flows into the fluid pipe 8 of the inter-unit pipeline 5 through the first in-unit fluid pipe 29. On the other hand, the refrigerant discharged from the second compressor 30 flows sequentially to the refrigerant discharge pipe 37, the four-way valve 31, and the second outdoor heat exchanger 32, is condensed and liquefied in the second outdoor heat exchanger 32 and then, flows into the fluid pipe 8 of the inter-unit pipeline 5 through the fluid pipe 36 and merges with the refrigerant flowing out of the first outdoor unit 2 in this fluid pipe 8.

The liquid refrigerant flowing through the fluid pipe 8 is distributed to the indoor expansion valves 11A to 11D of the indoor units 4A and 4D and decompressed therein. Then, the decompressed refrigerant is evaporated and vaporized in each of the indoor heat exchangers 10A and 10D, whereby all the indoor units 4A to 4D are cooled at the same time.

The refrigerant evaporated and vaporized in the indoor heat exchangers 10A and 10B of the indoor units 4A and 4B flows into the low-pressure gas pipe 6 through the second opening/closing valves 16A and 16B and the low-pressure gas branch pipes 14A and 14B, respectively. The refrigerant flowing through this low-pressure gas pipe 6 flows into the first outdoor unit 2 and is sucked by the first compressor 20 through the refrigerant sucking branch pipe 28A and the refrigerant sucking pipe 28.

On the other hand, the refrigerant evaporated and vaporized in the indoor heat exchangers 10C and 10D of the indoor units 4C and 4D flows into the high-pressure gas pipe 7 through the first opening/closing valves 15C and 15D and the low-pressure gas branch pipes 14C and 14D, respectively. The refrigerant flowing through the high-pressure gas pipe 7 flows into the second outdoor unit 3 through the third four-way valve 51 of the valve-element kit 50 and the gas pipe 35 and is sucked into the second compressor 30 through the four-way valve 31 and the refrigerant sucking pipe 41.

As mentioned above, in this configuration, by switching the first four-way valve 60 of the first outdoor unit 2 and the third four-way valve 51 of the valve-element kit 50, the refrigerant can be returned to the first outdoor unit 2 through the low-pressure gas pipe 6, while the refrigerant can be returned to the second outdoor unit 3 through the high-pressure gas pipe 7. According to this, since a return pipeline for the refrigerant can be disposed separately for each outdoor unit, pipe diameters of the low-pressure gas pipe 6 and the high-pressure gas pipe 7 can be made relatively large with respect to a refrigerant flow rate flowing through the low-pressure gas pipe 6 and the high-pressure gas pipe 7, and a pressure loss of the refrigerant in the low-pressure gas pipe 6 and the high-pressure gas pipe 7 can be suppressed.

Thus, if all the indoor units 4A to 4D are made to perform the cooling operation, the pressure loss of the refrigerant in the low-pressure gas pipe 6 and the high-pressure gas pipe 7 is suppressed, by which a drop in the sucking pressure of the first compressor 20 and the second compressor 30 in the first outdoor unit 2 and the second outdoor unit 3 can be prevented and thus, a drop in the cooling capacity can be prevented.

In this case, since the capacity of the first compressor 20 of the first outdoor unit 2 is set at least at a half of the capacity of all the compressors disposed in the air conditioner 1, that is, set equal to or more of the capacity of the second compressor 30 of the second outdoor unit 3, the refrigerant amount discharged from the first compressor 20 is larger in the quantity than the refrigerant amount discharged from the second compressor 30. Thus, to the first compressor 20, the low-pressure gas pipe 6, which is formed with a pipe diameter larger than that of the high-pressure gas pipe 7, is preferably connected.

Also, in this configuration, for each of the indoor units 4A to 4D, a pipeline into which the refrigerant evaporated in each of the indoor heat exchangers 10A to 10D flows can be selected from the low-pressure gas pipe 6 or the high-pressure gas pipe 7 by switching the first opening/closing valves 15A to 15D and the second opening/closing valves 16A and 16D as appropriate. According to this, the outdoor unit that performs the cooling operation can be selected in accordance with the indoor units 4A to 4D. Thus, since evaporation temperatures of the indoor units 4A to 4D can be made different according to the outdoor unit, by raising the evaporation temperature of an indoor unit with a smaller load, for example, operation efficiency of the outdoor unit connected to these indoor units can be improved.

Figure 2:
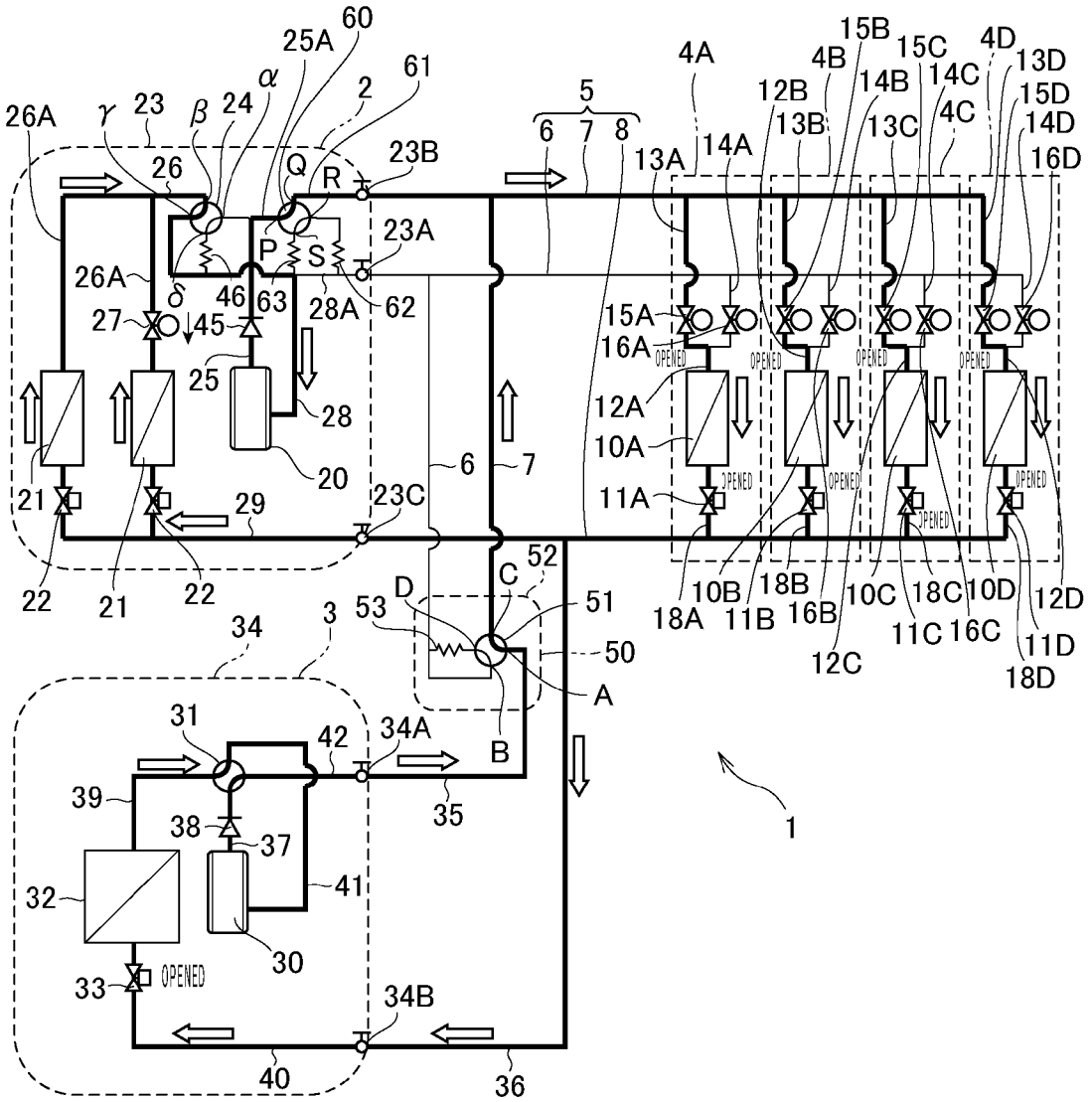
FIG. 2 is a circuit diagram illustrating the flow of the refrigerant when the air conditioner performs a heating operation.

If all the indoor units 4A to 4D are made to perform the heating operation at the same time, the low-pressure gas pipe 6 is brought into a sleep state. In this case, as shown in FIG. 2, in the first outdoor unit 2, the second four-way valve 24 is switched to a position (a first switching position) where the first outdoor heat exchangers 21 and 21 and the refrigerant sucking pipe 28 communicate with each other, that is, the first port $\alpha$ and the fourth port $\delta$ as well as the second port $\beta$ and the third port $\gamma$ of the second four-way valve 24 communicate with each other, the electromagnetic opening/closing valve 27 is opened, and opening degrees of the first expansion valves 22 and 22 are adjusted according to an air-conditioning load. Also, the first four-way valve 60 is switched to a position where the refrigerant discharge pipe 25 of the first compressor 20 and the high-pressure gas pipe 7 communicate with each other, that is, a position where the first port P and the second port Q as well as the third port R and the fourth port S of the first four-way valve 60 communicate with each other.

Also, in the second outdoor unit 3, the four-way valve 31 is switched to a position of the heating operation where the discharge refrigerant of the second compressor 30 is led to the gas pipe 35. Also, in all the indoor units 4A to 4D, the first opening/closing valves 15A to 15D are opened, and the second opening/closing valves 16A to 16D are closed. Also, in the valve-element kit 50, the third four-way valve 51 is switched to the position where the first port A and the third port C as well as the second port B and the fourth port D communicate with each other.

As a result, the refrigerant discharged from the first compressor 20 flows into the high-pressure gas pipe 7 of the inter-unit pipeline 5 through the refrigerant discharge pipe 25, the refrigerant discharge branch pipe 25A, the first four-way valve 60, and the in-unit high-pressure gas pipe 61. On the other hand, the refrigerant discharged from the second compressor 30 flows into the high-pressure gas pipe 7 of the inter-unit pipeline 5 through the refrigerant discharge pipe 37, the four-way valve 31, the in-unit gas pipe 42, the gas pipe 35, and the third four-way valve 51 of the valve-element kit 50 and merges with the refrigerant flowing out of the first outdoor unit 2 in this high-pressure gas pipe 7.

The gas refrigerant flowing through the high-pressure gas pipe 7 is distributed to the high-pressure gas branch pipes 13A to 13D of the indoor units 4A to 4D and then, flows into the first opening/closing valves 15A to 15D and the indoor heat exchangers 10A to 10D and is condensed and liquefied therein, respectively. The liquefied liquid refrigerant flows into the fluid pipe 8 through the fluid branch pipes 18A to 18D, and the liquid refrigerant is distributed to two parts in this fluid pipe 8.

One of the refrigerants flows into the first outdoor unit 2, is distributed to each of the first expansion valves 22 and 22 and is decompressed therein. Then, the decompressed refrigerant is evaporated and vaporized in each of the first outdoor heat exchangers 21 and 21 and then, merges in the in-unit gas pipe 26 and is sucked into the first compressor 20 through the second four-way valve 24 and the refrigerant sucking pipe 28. Also, the other refrigerant flows into the second outdoor unit 3 through the fluid pipe 36 and is decompressed by the second expansion valve 33. The decompressed refrigerant is evaporated and vaporized in the second outdoor heat exchanger 32 and then, is sucked into the second compressor 30 through the four-way valve 31 and the refrigerant sucking pipe 41. As mentioned above, all the indoor units 4A to 4D perform the heating operation at the same time in the indoor heat exchangers 10A to 10D working as condensers.

If the indoor units 4A to 4D are made to perform the cooling-heating mixed operation with an emphasis on the cooling and if the indoor units 4A to 4C are used for the cooling operation and the indoor unit 4D is used for the heating operation, for example, the low-pressure gas pipe 6, the high-pressure gas pipe 7, and the fluid pipe 8 are all used.

Figure 3:
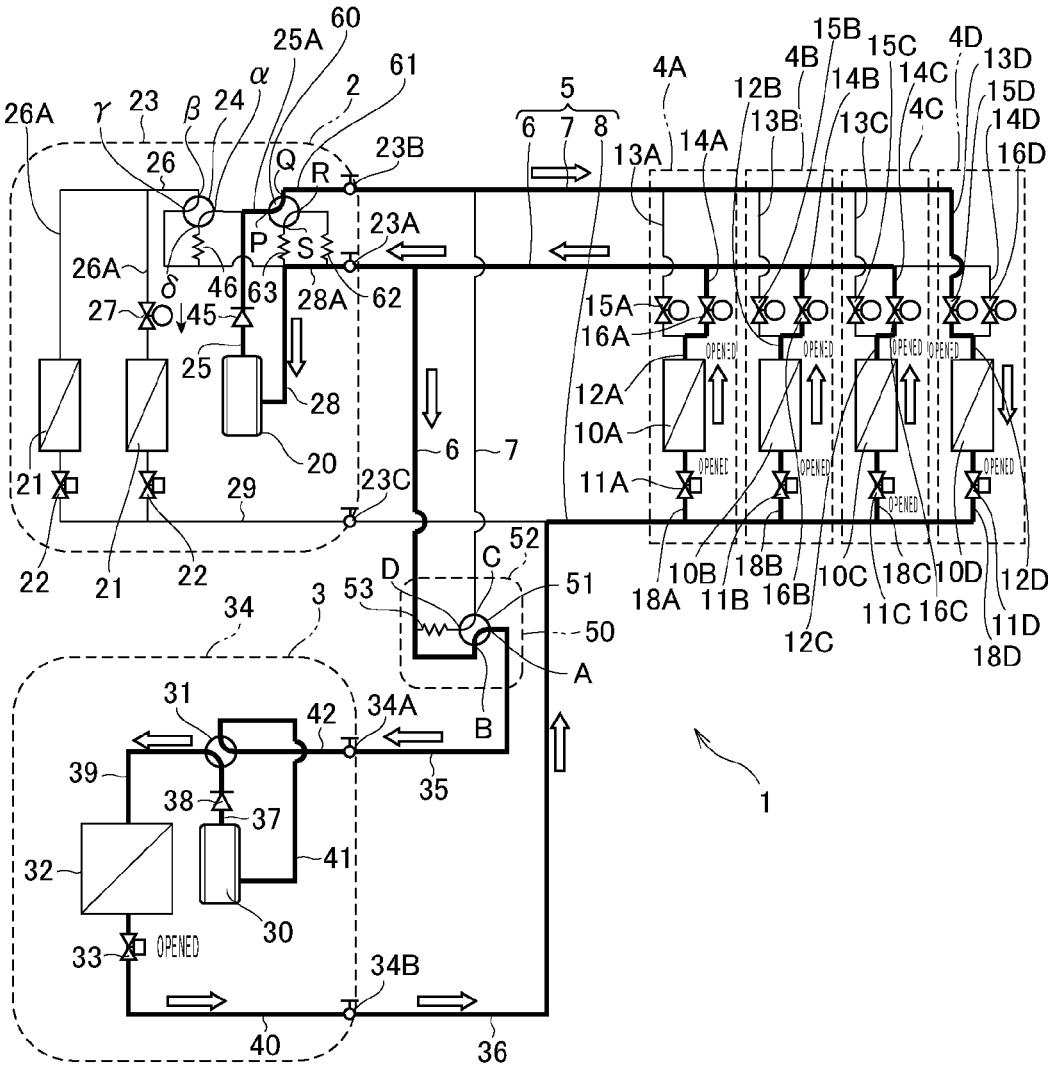
FIG. 3 is a circuit diagram illustrating the flow of the refrigerant when the air conditioner performs a mixed operation of cooling and heating with an emphasis on the cooling.

In this case, as shown in FIG. 3, in the first outdoor unit 2, the second four-way valve 24 is switched to the first switching position, and the first four-way valve 60 is switched to the position where the refrigerant discharge pipe 25 of the first compressor 20 communicates with the high-pressure gas pipe 7, that is, the position where the first port P and the second port Q as well as the third port R and the fourth port S of the first four-way valve 60 communicate with each other.

Also, the first expansion valves 22 and 22 are both closed, and the refrigerant does not flow into the first outdoor heat exchangers 21 and 21. That is because cooling loads in the indoor units 4A to 4C balanced with a heating load in the indoor unit 4D is borne by the first outdoor unit 2, while the excess cooling load is borne by the second outdoor unit 3, whereby a refrigerating cycle is formed.

Also, in the second outdoor unit 3, the four-way valve 31 is switched to the position of the cooling operation where the discharge refrigerant of the second compressor 30 is led to the second outdoor heat exchanger 32. Also, in the indoor units 4A to 4C, the first opening/closing valves 15A to 15C are closed, the second opening/closing valves 16A to 16C are opened, and in the indoor unit 4D, the first opening/closing valve 15D is opened, and the second opening/closing valve 16D is closed. Also, in the valve-element kit 50, the third four-way valve 51 is switched to a position where the first port A and the second port B as well as the third port C and the fourth port D communicate with each other.

As a result, the refrigerant discharged from the first compressor 20 flows into the indoor unit 4D through the refrigerant discharge pipe 25, the refrigerant discharge branch pipe 25A, the first four-way valve 60, the in-unit high-pressure gas pipe 61, and the high-pressure gas pipe 7. The refrigerant having flown into the indoor unit 4D flows into the indoor heat exchanger 10D through the high-pressure gas branch pipe 13D and the first opening/closing valve 15D, is condensed and liquefied therein and then, flows into the fluid pipe 8 through the fluid branch pipe 18D.

On the other hand, the refrigerant discharged from the second compressor 30 sequentially flows to the refrigerant discharge pipe 37, the four-way valve 31, and the second outdoor heat exchanger 32, is condensed and liquefied in this second outdoor heat exchanger 32 and then, flows into the fluid pipe 8 of the inter-unit pipeline 5 through the fluid pipe 36 and merges the refrigerant flowing out of the first outdoor unit 2 in this fluid pipe 8.

The liquid refrigerant flowing through the fluid pipe 8 is distributed to the indoor expansion valves 11A to 11C of the indoor units 4A to 4C and decompressed therein. Then, the decompressed refrigerant is evaporated and vaporized in each of the indoor heat exchangers 10A to 10C and then, flows into the low-pressure gas pipe 6 through the second opening/closing valves 16A to 16C, the low-pressure gas branch pipes 14A to 14C, respectively, and is distributed into two parts in this low-pressure gas pipe 6.

One of the refrigerants flows into the first outdoor unit 2 and is sucked into the first compressor 20 through the refrigerant sucking branch pipe 28A and refrigerant sucking pipe 28. Also, the other refrigerant flows into the second outdoor unit 3 through the third four-way valve 51 of the valve-element kit 50 and the gas pipe 35 and is sucked into the second compressor 30 through the four-way valve 31 and the refrigerant sucking pipe 41. As mentioned above, the indoor units 4A to 4C are cooled in the indoor heat exchangers 10A to 10C working as evaporators, respectively, while the indoor unit 4D is heated in the other indoor heat exchanger 10D working as a condenser.

In this configuration, the second outdoor unit 3 is connected to the inter-unit pipeline 5 through the valve-element kit 50, and the refrigerant condensed by the second outdoor heat exchanger 32 of the second outdoor unit 3 merges with the refrigerant condensed in the indoor heat exchanger 10D in the fluid pipe 8. Thus, in the case of the cooling-heating mixed operation, since condensing pressures (condensing temperatures) can be set independently for the indoor heat exchanger 10D and the second outdoor heat exchanger 32 working as condensers, if the outdoor temperature is low as in the winter, for example, the condensing pressure of the second outdoor heat exchanger 32 can be suppressed lower than the condensing pressure of the indoor heat exchanger 10D, whereby the workload (power consumption) of the second compressor 30 can be reduced.

Also, if cooling loads of the indoor units 4A to 4C are increased and cannot be handled by the second outdoor heat exchanger 32 of the second outdoor unit 3, in the first outdoor unit 2, the electromagnetic opening/closing valve 27 is closed, the first expansion valve 22 on the in-unit branch gas pipe 26A on which the electromagnetic opening/closing valve 27 is not disposed is opened, and a part of the refrigerant discharged from the first compressor 20 is led to the first outdoor heat exchanger 21, whereby the first outdoor heat exchanger 21 can be made to work as a condenser.

In this configuration, the first outdoor unit 2 is provided with the two first outdoor heat exchangers 21 and 21 arranged side by side, and by opening/closing the electromagnetic opening/closing valve 27, the refrigerant can be distributed and made to flow to each of the first outdoor heat exchangers 21 and 21, and thus, according to the load balance of the cooling load and the heating load during the cooling-heating mixed operation, the operation of the electromagnetic opening/closing valve 27 can be controlled so as to change the number of the first outdoor heat exchangers 21 and 21 used for the air-conditioning operation, whereby the operation efficiency during the air-conditioning operation can be improved.

In the case of the cooling-heating mixed operation with the emphasis on the heating of the indoor units 4A to 4D, if the indoor unit 4A is made to perform the cooling operation and the indoor units 4B to 4D are made to perform the heating operation, for example, the low-pressure gas pipe 6, the high-pressure gas pipe 7, and the fluid pipe 8 are all used.

Figure 4:
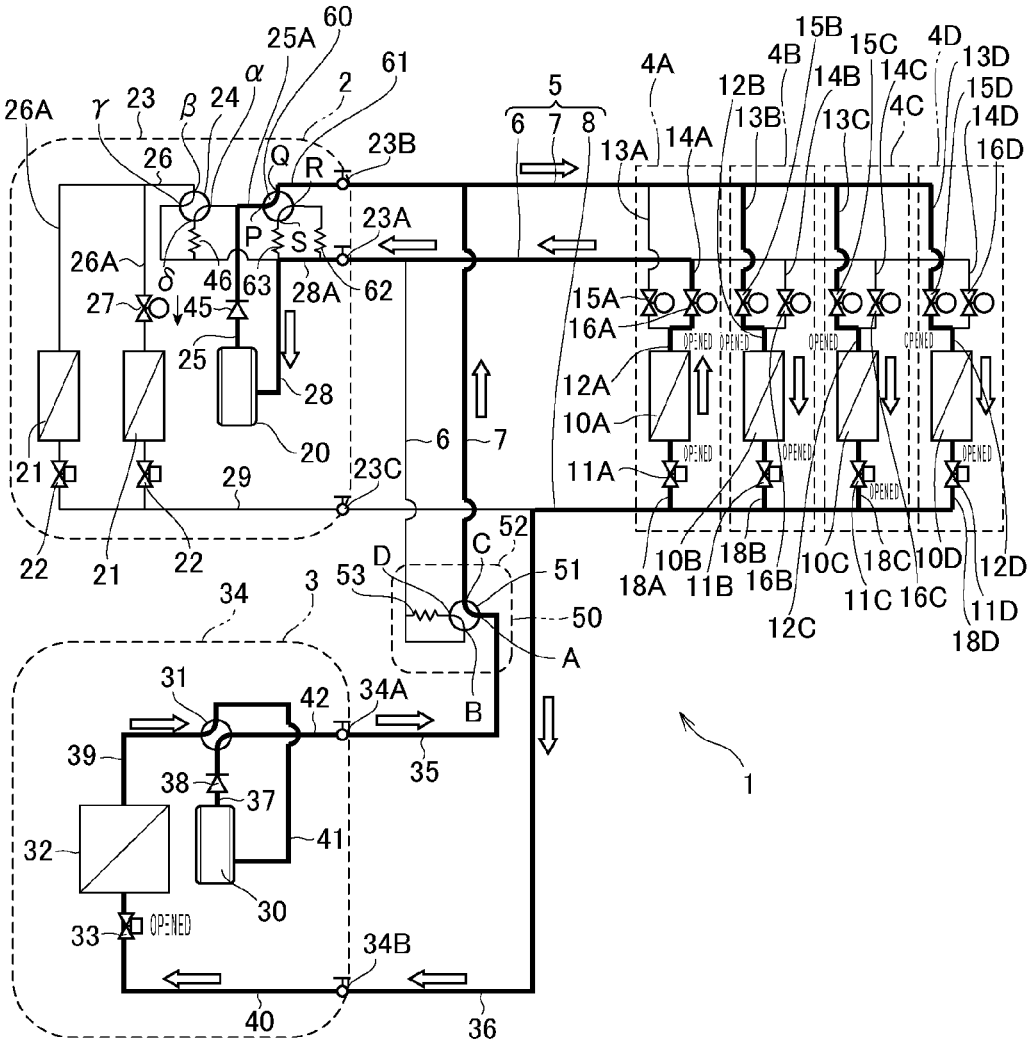
FIG. 4 is a circuit diagram illustrating the flow of the refrigerant when the air conditioner performs a mixed operation of cooling and heating with an emphasis on the heating.

In this case, as shown in FIG. 4, in the first outdoor unit 2, the second four-way valve 24 is switched to the first switching position, the first expansion valves 22 and 22 are both closed, and the refrigerant does not flow into the first outdoor heat exchangers 21 and 21. Also, the first four-way valve 60 is switched to the position where the refrigerant discharge pipe 25 of the first compressor 20 and the high-pressure gas pipe 7 communicate with each other, that is, the position where the first port P and the second port Q as well as the third port R and the fourth port S of the first four-way valve 60 communicate with each other.

Also, in the second outdoor unit 3, the four-way valve 31 is switched to the position of the heating operation where the discharge refrigerant of the second compressor 30 is led to the gas pipe 35. Also, in the indoor unit 4A, the first opening/closing valve 15A is closed and the second opening/closing valve 16A is opened, and in the indoor units 4B to 4D, the first opening/closing valves 15B to 15D are opened, and the second opening/closing valves 16B to 16D are closed. Also, in the valve-element kit 50, the third four-way valve 51 is switched to the position where the first port A and the third port C as well as the second port B and the fourth port D communicate with each other.

As a result, the refrigerant discharged from the first compressor 20 flows into the high-pressure gas pipe 7 of the inter-unit pipeline 5 through the refrigerant discharge pipe 25, the refrigerant discharge branch pipe 25A, the first four-way valve 60, and the in-unit high-pressure gas pipe 61. On the other hand, the refrigerant discharged from the second compressor 30 flows into the high-pressure gas pipe 7 of the inter-unit pipeline 5 through the refrigerant discharge pipe 37, the four-way valve 31, the in-unit gas pipe 42, the gas pipe 35, and the third four-way valve 51 of the valve-element kit 50 and merges with the refrigerant flowing out of the first outdoor unit 2 in this high-pressure gas pipe 7.

The gas refrigerant flowing through the high-pressure gas pipe 7 is distributed to the high-pressure gas branch pipes 13B to 13D of the indoor units 4B to 4D and then, flows into the first opening/closing valves 15B to 15D and the indoor heat exchangers 10B to 10D and is condensed and liquefied therein. The liquefied liquid refrigerant flows into the fluid pipe 8 through the fluid branch pipes 18B to 18D.

A part of the liquid refrigerant having flown into this fluid pipe 8 flows into the indoor unit 4A and is decompressed by the indoor expansion valve 11A of the indoor unit 4A and the decompressed refrigerant is evaporated and vaporized in the indoor heat exchanger 10A. Then, the vaporized gas refrigerant flows into the first outdoor unit 2 through the second opening/closing valve 16A, the low-pressure gas branch pipe 14A, and the low-pressure gas pipe 6 and is sucked into the first compressor 20 through the refrigerant sucking branch pipe 28A and the refrigerant sucking pipe 28.

On the other hand, the remaining liquid refrigerant having flown into the liquid pipe 8 flows into the second outdoor unit 3 through the fluid pipe 36 and is decompressed by the second expansion valve 33. Then, the decompressed refrigerant is evaporated and vaporized in the second outdoor heat exchanger 32 and then, is sucked into the second heat compressor 30 through the four-way valve 31 and the refrigerant sucking pipe 41. As mentioned above, the indoor unit 4A is cooled by the indoor heat exchanger 10A working as an evaporator, while the indoor units 4B to 4D are heated by the other indoor heat exchangers 10B to 10D working as condensers, respectively.

In this configuration, since the second outdoor unit 3 is connected to the inter-unit pipeline 5 through the valve-element kit 50, a part of the refrigerant condensed in each of the indoor heat exchangers 10B to 10D of each of the indoor units 4B to 4D can be led to the indoor heat exchanger 10A of the indoor unit 4A, while the remaining refrigerant can be led to the second outdoor heat exchanger 32 of the second outdoor unit 3. Thus, in the case of the cooling-heating mixed operation, evaporation pressures (evaporation temperatures) of the indoor heat exchanger 10A and the second outdoor heat exchanger 32 working as evaporators can be set independently. Thus, if the outside temperature is low as in the winter, for example, the evaporation temperature of the indoor heat exchanger 10D can be set at an appropriate temperature higher than the evaporation temperature of the second outdoor heat exchanger 32 as compared with the evaporation temperature of the second outdoor heat exchanger 32, which is lowered with this outdoor temperature. As a result, since a drop in the evaporation temperature of the indoor heat exchanger 10D due to an influence of the outdoor temperature is prevented, means that prevents freezing of the indoor heat exchanger 10D is no longer required.

Also, if the heating loads of the indoor units 4B to 4D are increased and cannot be borne by the second outdoor heat exchanger 32 of the second outdoor unit 3, in the first outdoor unit 2, the electromagnetic opening/closing valve 27 is closed, the first expansion valve 22 on the in-unit branch gas pipe 26A on which this electromagnetic opening/closing valve 27 is not disposed is opened so that apart of the refrigerant discharged from the first compressor 20 is led to the first outdoor heat exchanger 21, whereby the first outdoor heat exchanger 21 can be made to work as an evaporator.

As mentioned above, according to this embodiment, in the air conditioner 1 constituted by the triple-pipeline type first outdoor unit 2 provided with the first compressor 20, the first outdoor heat exchanger 21, and the first expansion valve 22 and connected to the three inter-unit pipelines 5 made up of the high-pressure gas pipe 7, the low-pressure gas pipe 6, and the fluid pipe 8 and by the plurality of indoor units 4A to 4D provided with the indoor heat exchangers 10A to 10D and configured so that the indoor units 4A to 4D can perform the cooling operation or the heating operation at the same time or the cooling operation and the heating operation can be performed in a mixed manner, the second outdoor unit 3 provided with the second compressor 30, the second outdoor heat exchanger 32, and the second expansion valve 33 and connected by two pipelines of the gas pipe 35 and the fluid pipe 36, and the valve-element kit 50 having the third four-way valve 51 that connects the fluid pipe 36 of the second outdoor unit 3 to the fluid pipe 8 of the inter-unit pipeline 5 and also selectively connects the gas pipe 35 of the second outdoor unit 3 to the high-pressure gas pipe 7 or the low-pressure gas pipe 6 of the inter-unit pipeline 5 are provided, in which the first outdoor unit 2 is provided with the first four-way valve 60 that makes the refrigerant discharge pipe 25 of the first compressor 20 capable of communicating with the high-pressure gas pipe 7, and if all the indoor units 4A to 4D are to perform the cooling operation at the same time, the first four-way valve 60 shuts off communication between the refrigerant discharge pipe 25 and the high-pressure gas pipe 7 and the third four-way valve 51 is switched so as to connect the gas pipe 35 to the high-pressure gas pipe 7.

Therefore, by switching the first four-way valve 60 of the first outdoor unit 2 and the third four-way valve 51 of the valve-element kit 50, respectively, the refrigerant is returned to the first outdoor unit 2 through the low-pressure gas pipe 6, and the refrigerant can be returned to the second outdoor unit 3 through the high-pressure gas pipe 7. According to this, since a refrigerant return pipeline can be provided separately for each outdoor unit, the pipe diameters of the low-pressure gas pipe 6 and the high-pressure gas pipe 7 can be made relatively larger with respect to the flow rates of the refrigerant flowing through the low-pressure gas pipe 6 and the high-pressure gas pipe 7, whereby the pressure loss of the refrigerant in the low-pressure gas pipe 6 and the high-pressure gas pipe 7 can be suppressed. Thus, if all the indoor units 4A to 4D perform the cooling operation, the drop in the sucking pressure of the first compressor 20 and the second compressor 30 in the first outdoor unit 2 and the second outdoor unit 3 can be prevented, and therefore, the drop in the cooling capacity can be prevented.

Also, in each of the indoor units 4A to 4D, by switching the first opening/closing valves 15A to 15D and the second opening/closing valves 16A to 16D as appropriate, the pipeline into which the refrigerant evaporated in each of the indoor heat exchangers 10A to 10D flows can be selected from the low-pressure gas pipe 6 or the high-pressure gas pipe 7, and the outdoor unit to perform the cooling operation in accordance with the indoor units 4A to 4D can be selected. Therefore, since the evaporation temperatures of the indoor units 4A to 4D can be made different according to the outdoor unit, by raising the evaporation temperature of an indoor unit with a smaller load, the operation efficiency of the outdoor unit connected to these indoor units can be improved, for example.

Also, according to this embodiment, since the first four-way valve 60 connects the refrigerant discharge branch pipe 25A branching from the refrigerant discharge pipe 25 to the first port P, connects the high-pressure gas pipe 7 to the second port Q through the in-unit high-pressure gas pipe 61, and connects the refrigerant sucking branch pipe 28A continuing to the low-pressure gas pipe 6 to the third port R and the fourth port S through the capillary tubes 62 and 63, the refrigerant discharge pipe 25 and the high-pressure gas pipe 7 can be made to communicate with each other or shut off from each other with a simple and inexpensive configuration in which the first four-way valve 60 is interposed.

Also, according to this embodiment, the first outdoor unit 2 is provided with the second four-way valve 24 between the first compressor 20 and the first outdoor heat exchangers 21 and 21, the high-pressure gas pipe 7 is connected to the refrigerant discharge branch pipe 25A branching from between this second four-way valve 24 and the first compressor 20 through the first four-way valve 60 and the in-unit high-pressure gas pipe 61, the low-pressure gas pipe 6 is connected to the refrigerant sucking branch pipe 28A branching from between the second four-way valve 24 and the first compressor 20, the second four-way valve 24 is made to communicate with the low-pressure gas pipe 6 and the first outdoor heat exchanger 21 at the first switching position, and the first compressor 20 and the first outdoor heat exchanger 21 are made to communicate with each other at the second switching position, and thus, the first outdoor unit 2 connected to the three inter-unit pipelines 5 can be constructed only by changing a part of the pipeline configuration of the existing so-called double-pipeline type outdoor unit having the compressor, the four-way valve, and the outdoor heat exchanger, and a manufacturing cost can be reduced as compared with a case in which the triple-pipeline type outdoor unit is independently developed.

Also, since the first outdoor unit 2 is constituted on the basis of the so-called double-pipeline type outdoor unit, size reduction of the device can be realized as compared with the prior-art triple-pipeline type outdoor unit.

Also, according to this embodiment, the valve-element kit 50 is provided with the single third four-way valve 51, the gas pipe 35 is connected to the first port A of this third four-way valve 51, the low-pressure gas pipe 6 is connected to the second port B, the high-pressure gas pipe 7 is connected to the third port C, and the low-pressure gas pipe 6 is connected to the fourth-port D through the capillary tube 53, and thus, with the simple configuration in which the third four-way valve 51 is interposed, the gas pipe 35 of the second outdoor unit 3 can be selectively connected to the high-pressure gas pipe 7 or the low-pressure gas pipe 6 of the inter-unit pipeline 5, and the second outdoor unit 3 constituted by the so-called double-pipeline type outdoor unit can be connected to the triple-pipeline type air conditioner 1.

According to this embodiment, since the valve-element kit 50 is disposed outside the second unit case 34 of the second outdoor unit 3, the existing double-pipeline type outdoor unit can be used as the second outdoor unit 3 as it is without changing the pipeline configuration thereof, and the configuration of the triple pipeline type air conditioner 1 can be simplified.

Also, according to this embodiment, since the capacity of the first compressor 20 is constituted to be provided with the capacity of at least a half of all the compressors provided in the air conditioner 1, in the case of the load balance of the cooling load and the heating load of the cooling-heating mixed operation at 50%:50%, the air-conditioning operation can be performed using the first outdoor unit 2 provided with the first compressor 20, and if the cooling load or the heating load is increased and the load balance is changed, the excess load of the cooling load or the heating load can be borne by the second outdoor unit 3. Thus, however changed the load balance of the cooling load and the heating load during the cooling-heating mixed operation is, the air-conditioning operation with the load balance can be realized.

The present invention has been described above on the basis of the above embodiment, but the present invention is not limited to that. For example, in this embodiment, the first four-way valve 60 is configured to be provided as a valve element that makes the refrigerant discharge pipe 25 of the first compressor 20 and the high-pressure gas pipe 6 capable of communicating with each other, but not limited to that, and an electromagnetic opening/closing valve may be disposed instead of the first four-way valve 60.

Also, the valve-element kit 50 is configured to be provided with the third four-way valve 51 as a channel switching valve, but not limited to that, a plurality of electromagnetic opening/closing valves may be combined.

Second Embodiment

A second embodiment will be described below referring to the attached drawings.

Figure 5:
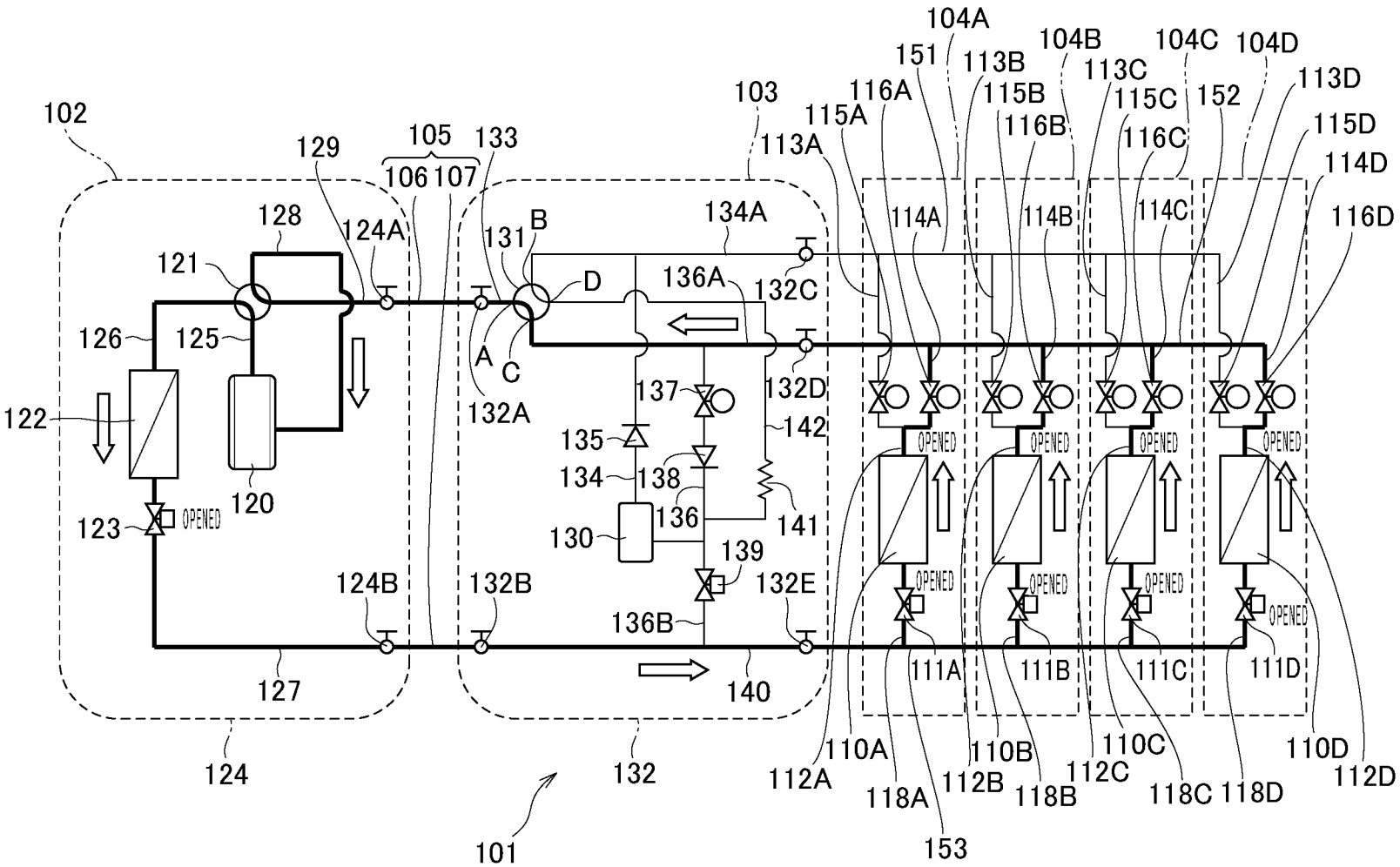
FIG. 5 shows an air conditioner according to a second embodiment of the present invention and is a circuit diagram illustrating a flow of a refrigerant when the air conditioner performs a cooling operation.

FIG. 5 is a circuit diagram illustrating an air conditioner according to the second embodiment. This air conditioner 101 is provided with a double-pipeline type outdoor unit 102, a plurality of (four, for example) indoor units 104A, 104B, 104C, and 104D, and a switching unit 103 disposed between the outdoor unit 102 and the indoor units 104A to 104D. This switching unit 103 is connected to two inter-unit pipelines 105 made up of a gas pipe 106 and a fluid pipe 107 extending from the outdoor unit 102 and it is a unit that switches the gas pipe 106 and the fluid pipe 107 to a high-pressure gas pipe 151, a low-pressure gas pipe 152, and a fluid pipe 153 and connects them to the indoor units 104A to 104D.

In this configuration, the air conditioner 101 makes a simultaneous cooling operation or heating operation of the indoor units 104A to 104D or the cooling operation and the heating operation can be performed in a mixed manner using the double-pipeline type outdoor unit 102 by interposing the switching unit 103.

The indoor unit 104A includes an indoor heat exchanger 110A and an indoor expansion valve 111A, and one end of the indoor heat exchanger 110A is connected to the fluid pipe 153 through a fluid branch pipe 118A on which the indoor expansion valve 111A is disposed. To the other end of the indoor heat exchanger 110A, a branch pipe 112A is connected, and this branch pipe 112A branches to a high-pressure gas branch pipe 113A and a low-pressure gas branch pipe 114A. The high-pressure gas branch pipe 113A is connected to the high-pressure gas pipe 151 through a first opening/closing valve 115A, while the low-pressure gas branch pipe 114A is connected to the low-pressure gas pipe 152 through a second opening/closing valve 116A.

Also, the indoor unit 104A is provided with temperature sensors (not shown) that detect inlet/outlet temperatures of the indoor heat exchanger 110A and a room temperature, pressure sensors (not shown) that detect a refrigerant pressure in the indoor heat exchanger 110A and the like arranged and in addition, an indoor controller (not shown) that receives inputs of detection results of these sensors and executes control of the indoor unit 104A. Since the indoor units 104B to 104D have substantially the same configuration as that of the indoor unit 104A, the same reference numerals are given to the same portions and the description will be omitted.

The outdoor unit 102 includes a variable-capacity type compressor (DC inverter compressor) 120, a four-way valve 121, an outdoor heat exchanger 122, an outdoor expansion valve 123, and a unit case 124 that contains them, and in this unit case 124, a gas-pipe service valve 124A and a fluid-pipe service valve 124B to which devices in the unit case 124 and the two pipelines of the gas pipe 106 and the fluid pipe 107 are connected, respectively, are disposed.

The outdoor unit 102 is an existing double-pipeline type (two-way) outdoor unit that can perform the cooling operation or the heating operation by switching of the four-way valve 121. A refrigerant discharge pipe 125 of the compressor 120 is connected to the four-way valve 121, and the four-way valve 121 is connected to one end of the outdoor heat exchanger 122 through an in-unit gas pipe 126. To the other end of the outdoor heat exchanger 122, an in-unit fluid pipe 127 is connected, and this in-unit fluid pipe 127 is connected to the fluid-pipe service valve 124B through the outdoor expansion valve 123.

On the other hand, a refrigerant sucking pipe 128 of the compressor 120 is connected to the four-way valve 121, and to this four-way valve 121, the gas-pipe service valve 124A is connected through an in-unit gas pipe 129.

Also, the outdoor unit 102 is provided with pressure sensors (not shown) that detect a sucking pressure and a discharge pressure of the compressor 120 and a refrigerant pressure in the outdoor heat exchanger 122 and temperature sensors (not shown) that detect an inlet/outlet temperature of the outdoor heat exchanger 122 and an outside temperature and the like arranged and in addition, an outdoor controller (not shown) that receives inputs of detection results of these sensors and executes control of the outdoor unit 102.

The switching unit 103 is provided with a variable-capacity type auxiliary compressor (DC inverter compressor) 130 that assists the compressor 120 of the outdoor unit 102 and forms a refrigerating cycle, a four-way valve 131, and a unit case 132 that contains them. In this unit case 132, a gas-pipe service valve 132A and a first fluid-pipe service valve 132B to which devices in the unit case 132 as well as the gas pipe 106 and the fluid pipe 107 of the inter-unit pipeline 105 are connected, respectively, a high-pressure gas-pipe service valve 132C, a low-pressure gas-pipe service valve 132D, and a second fluid-pipe service valve 132E to which the devices as well as the high-pressure gas pipe 51, the low-pressure gas pipe 52, and the fluid pipe 53 are connected, respectively, are disposed.

In this configuration, the capacity of the auxiliary compressor 130 is constituted to be provided with the capacity of at least a half of the compressor 120 of the outdoor unit 2. According to this, if the cooling-heating mixed operation is performed with the load balance of the cooling load and the heating load of 50%:50%, for example, the cooling and the heating operations of the indoor units 104A to 104D can be performed using only the auxiliary compressor 130, and thus, the operation of the outdoor unit 102 can be stopped. Also, if the cooling load or the heating load is increased and the load balance of the cooling load and the heating load is changed to 60%:40%, for example, the excess cooling load can be borne by the outdoor unit 102. Thus, however changed the load balance of the cooling load and the heating load of the indoor units 104A to 104D during the cooling-heating mixed operation is, the air-conditioning operation with the load balance can be realized.

The four-way valve 131 is provided with four ports, in which one end of an in-unit gas pipe 133 is connected to a first port A, while the other end of this in-unit gas pipe 133 is connected to the gas pipe 106 of the inter-unit pipeline 105 through the gas-pipe service valve 132A.

Also, to a second port B of the four-way valve 131, a refrigerant discharge pipe 134 of the auxiliary compressor 130 is connected. To this refrigerant discharge pipe 134, one end of a refrigerant discharge branch pipe 134A branching between the auxiliary compressor 130 and the four-way valve 131 is connected, while the other end of this refrigerant discharge branch pipe 134A is connected to the high-pressure gas pipe 151 through the high-pressure gas-pipe service valve 132C. Reference numeral 135 denotes a check valve.

To a third port C of the four-way valve 131, a refrigerant sucking pipe 136 of the auxiliary compressor 130 is connected, and in this refrigerant sucking pipe 136, an electromagnetic opening/closing valve 137 and a check valve 138 are disposed. Also, to the refrigerant sucking pipe 136, one end of a first refrigerant sucking branch pipe 136A branching between the electromagnetic opening/closing valve 137 and the four-way valve 131 is connected, while the other end of the first refrigerant sucking branch pipe 136A is connected to the low-pressure gas pipe 152 through the low-pressure gas-pipe service valve 132D. Moreover, to the refrigerant sucking pipe 136, one end of a second refrigerant sucking branch pipe (refrigerant sucking branch pipe) 136B branching between the check valve 138 and the auxiliary compressor 130 is connected, while the other end of this second refrigerant sucking branch pipe 136B is connected to an in-unit fluid pipe 140 through an opening-degree regulating valve 139. This in-unit fluid pipe 140 is connected to the fluid pipe 107 of the inter-unit pipeline 105 and the fluid pipe 153 through the first fluid-pipe service valve 132B and the second fluid-pipe service valve 132E, respectively.

Also, to a fourth port D of the four-way valve 131, one end of a connection pipe 142 provided with a capillary tube 141 is connected, and the other end of this connection pipe 142 is connected to the refrigerant sucking pipe 136 between the auxiliary compressor 130 and the check valve 138. The connection pipe 142 in which this capillary tube 141 is disposed is provided in order to gradually return collection of the refrigerant in the indoor heat exchangers 110A to 110D connected to the outdoor unit 102 to the refrigerant sucking pipe 136 of the auxiliary compressor 130 (that is, in order to prevent accumulation of the refrigerant) if the outdoor unit 102 is stopped due to thermo-off or the like, for example.

This switching unit 103 is preferably disposed close to each of the indoor units 104A to 104D. According to this configuration, the air conditioner 101 can be constituted by using the existing inter-unit pipeline 105 made up of the gas pipe 106 and the fluid pipe 107, and the cooling operation or the heating operation of each of the indoor units 104A to 104D is made possible or the cooling operation and the heating operation can be performed in a mixed manner with the simple configuration in which the outdoor unit 102, the switching unit 103 and the indoor units 104A to 104D are connected to the existing inter-unit pipeline 105.

Subsequently, the operation of this air conditioner 101 will be described.

If all the indoor units 104A to 104D are made to perform the cooling operation at the same time, as shown in FIG. 5, in the outdoor unit 102, the four-way valve 121 is switched to a position of the cooling operation where the discharged refrigerant of the compressor 120 is led to the outdoor heat exchanger 122, while in the indoor units 104A to 104D, the first opening/closing valves 115A to 115D are closed, and the second opening/closing valves 116A to 116D are opened.

Also, in the switching unit 103, the operation of the auxiliary compressor 130 is stopped, the four-way valve 131 is switched to a position (first switching position) where the gas pipe 106 of the inter-unit pipeline 105 and the low-pressure gas pipe 152 communicate with each other, that is, the first port A and the third port C as well as the second port B and the fourth port D of the four-way valve 131 communicate with each other, and the electromagnetic opening/closing valve 137 and the opening-degree regulating valve 139 are closed.

As a result, the refrigerant discharged from the compressor 120 sequentially flows to the refrigerant discharge pipe 125, the four-way valve 121, the in-unit gas pipe 126, and the outdoor heat exchanger 122 and is condensed and liquefied in this outdoor heat exchanger 122 and then, flows into the fluid pipe 153 through the in-unit fluid pipe 127, the fluid pipe 107 of the inter-unit pipeline 105, and the in-unit fluid pipe 140 of the switching unit 103.

The liquid refrigerant flowing through the fluid pipe 153 is distributed to the indoor expansion valves 111A to 111D of the indoor units 104A to 104D and decompressed therein. Then, the decompressed refrigerant is evaporated and vaporized in each of the indoor heat exchangers 110A to 110D and then, flows into the low-pressure gas pipe 152 through the second opening/closing valves 116A to 116D and the low-pressure gas branch pipes 114A to 114D, respectively, The gas refrigerant flowing through this low-pressure gas pipe 152 flows through the gas pipe 106 of the inter-unit pipeline 105 through the first refrigerant sucking branch pipe 136A, the refrigerant sucking pipe 136, and the four-way valve 131 of the switching unit 103, flows into the outdoor unit 102, and is sucked into the compressor 120 through the in-unit gas pipe 129, the four-way valve 121, and the refrigerant sucking pipe 128. As mentioned above, all the indoor units 14A to 14D are cooled at the same time by each of the indoor heat exchangers 110A to 110D working as evaporators.

Figure 6:
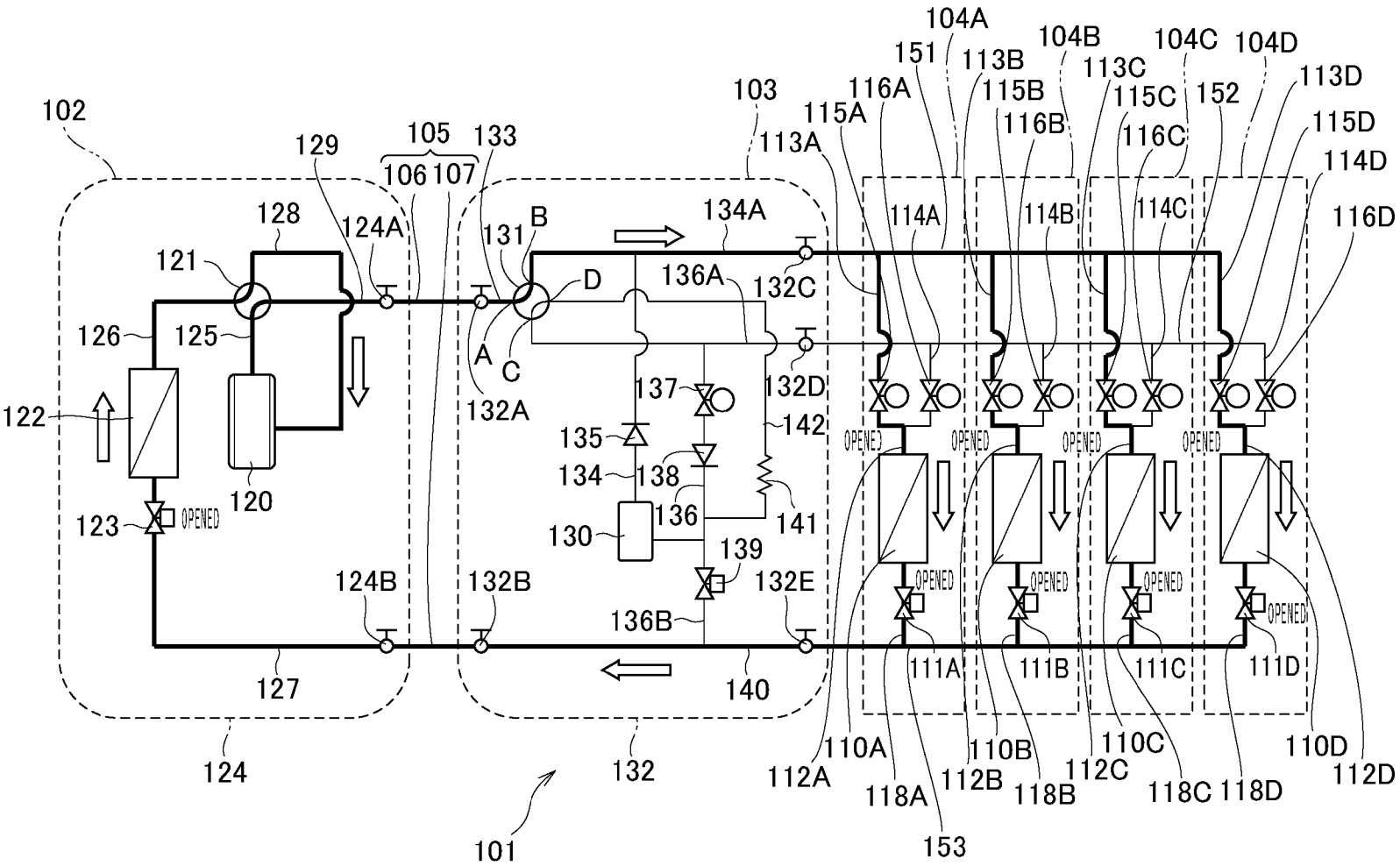
FIG. 6 is a circuit diagram illustrating the flow of the refrigerant when the air conditioner performs a heating operation.

If all the indoor units 104A to 104D are made to perform the heating operation at the same time, as shown in FIG. 6, in the outdoor unit 102, the four-way valve 121 is switched to a position of the heating operation where the discharged refrigerant of the compressor 120 is led to the gas pipe 106, and in all the indoor units 104A to 104D, the first opening/closing valves 115A to 115D are opened, and the second opening/closing valves 116A to 116D are closed.

Also, in the switching unit 103, the operation of the auxiliary compressor 130 is stopped, and the four-way valve 131 is switched to a position (second switching position) where the gas pipe 106 of the inter-unit pipeline 105 and the high-pressure gas pipe 151 communicate with each other, that is, the first port A and the second port B as well as the third port C and the fourth port D of the four-way valve 131 communicate with each other, and the electromagnetic opening/closing valve 137 and the opening-degree regulating valve 139 are closed.

As a result, the refrigerant discharged from the compressor 120 flows into the gas pipe 106 of the inter-unit pipeline 105 through the refrigerant discharge pipe 125, the four-way valve 121, and the in-unit gas pipe 129. The gas refrigerant flowing through this gas pipe 106 flows into the switching unit 103 and flows into the high-pressure gas pipe 151 through the in-unit gas pipe 133, the four-way valve 131, the refrigerant discharge pipe 134, and the refrigerant discharge branch pipe 134A of the switching unit 103. The gas refrigerant having flown into the high-pressure gas pipe 151 is distributed to the high-pressure gas branch pipes 113A to 113D of the indoor units 104A and 104D and then, flows into the first opening/closing valves 115A to 115D and the indoor heat exchangers 110A to 110D and is condensed and liquefied therein, respectively. The liquefied liquid refrigerant flows into the fluid pipe 153 through the fluid branch pipes 118A to 118D.

The liquid refrigerant flowing through the fluid pipe 153 flows into the outdoor unit 102 through the in-unit fluid pipe 140 of the switching unit 103, reaches the in-unit fluid pipe 127 and the outdoor expansion valve 123 of the outdoor unit 102 and is decompressed therein. Then, the decompressed refrigerant is evaporated and vaporized in the outdoor heat exchanger 122 and then, is sucked into the compressor 120 through the in-unit gas pipe 126, the four-way valve 121, and the refrigerant sucking pipe 128. As mentioned above, all the indoor units 104A to 104D are heated at the same time by the indoor heat exchangers 110A to 110D working as condensers.

Here, if the outside temperature is extremely lowered as in the midwinter, for example, in the outdoor heat exchanger 122, it becomes difficult to take in heat from the outside air at an extremely low temperature, and thus, efficiency of the heating operation is lowered. In such a case, as shown in FIG. 7, in the switching unit 103, the auxiliary compressor 130 is operated, while the four-way valve 131 is switched to the first switching position where the gas pipe 106 of the inter-unit pipeline 105 and the refrigerant sucking pipe 136 of the auxiliary compressor 130 communicate with each other, and the electromagnetic opening/closing valve 137 and the opening-degree regulating valve 139 are opened.

As a result, the refrigerant discharged from the compressor 120 flows into the gas pipe 106 of the inter-unit pipeline 105 through the refrigerant discharge pipe 125, the four-way valve 121, and the in-unit gas pipe 129. The gas refrigerant flowing through the gas pipe 106 flows into the switching unit 103, is sucked into the auxiliary compressor 130 through the in-unit gas pipe 133, the four-way valve 131, and the refrigerant sucking pipe 136 of the switching unit 103 and is compressed by this auxiliary compressor 130 in two stages. The refrigerant discharged from the auxiliary compressor 130 flows into the high-pressure gas pipe 151 through the refrigerant discharge pipe 134 and the refrigerant discharge branch pipe 134A. The gas refrigerant flowing through the high-pressure gas pipe 151 is distributed to the high-pressure gas branch pipes 113A to 113D of the indoor units 104A to 104D and then, flows into the first opening/closing valves 115A to 115D and the indoor heat exchangers 110A to 110D and is condensed and liquefied therein, respectively. This liquefied liquid refrigerant flows into the fluid pipe 153 through the fluid branch pipes 118A to 118D.

The liquid refrigerant flowing through the fluid pipe 153 flows into the in-unit fluid pipe 140 of the switching unit 103 and is branched to two parts in this in-unit fluid pipe 140. One of the liquid refrigerants flows through the second refrigerant sucking branch pipe 136B and the opening-degree regulating valve 139, is decompressed by the opening-degree regulating valve 139 and then, flows into the refrigerant sucking pipe 136 of the auxiliary compressor 130, merges with the refrigerant discharged from the compressor 120 of the outdoor unit 102 in this refrigerant sucking pipe 136 and is sucked into the auxiliary compressor 130. Also, the other liquid refrigerant flows into the outdoor unit 102, reaches the in-unit fluid pipe 127 and the outdoor expansion valve 123 of the outdoor unit 102 and is decompressed therein, and the decompressed refrigerant is evaporated and vaporized in the outdoor heat exchanger 122 and then, is sucked into the compressor 120 through the in-unit gas pipe 126, the four-way valve 121, and the refrigerant sucking pipe 128.

Figure 7:
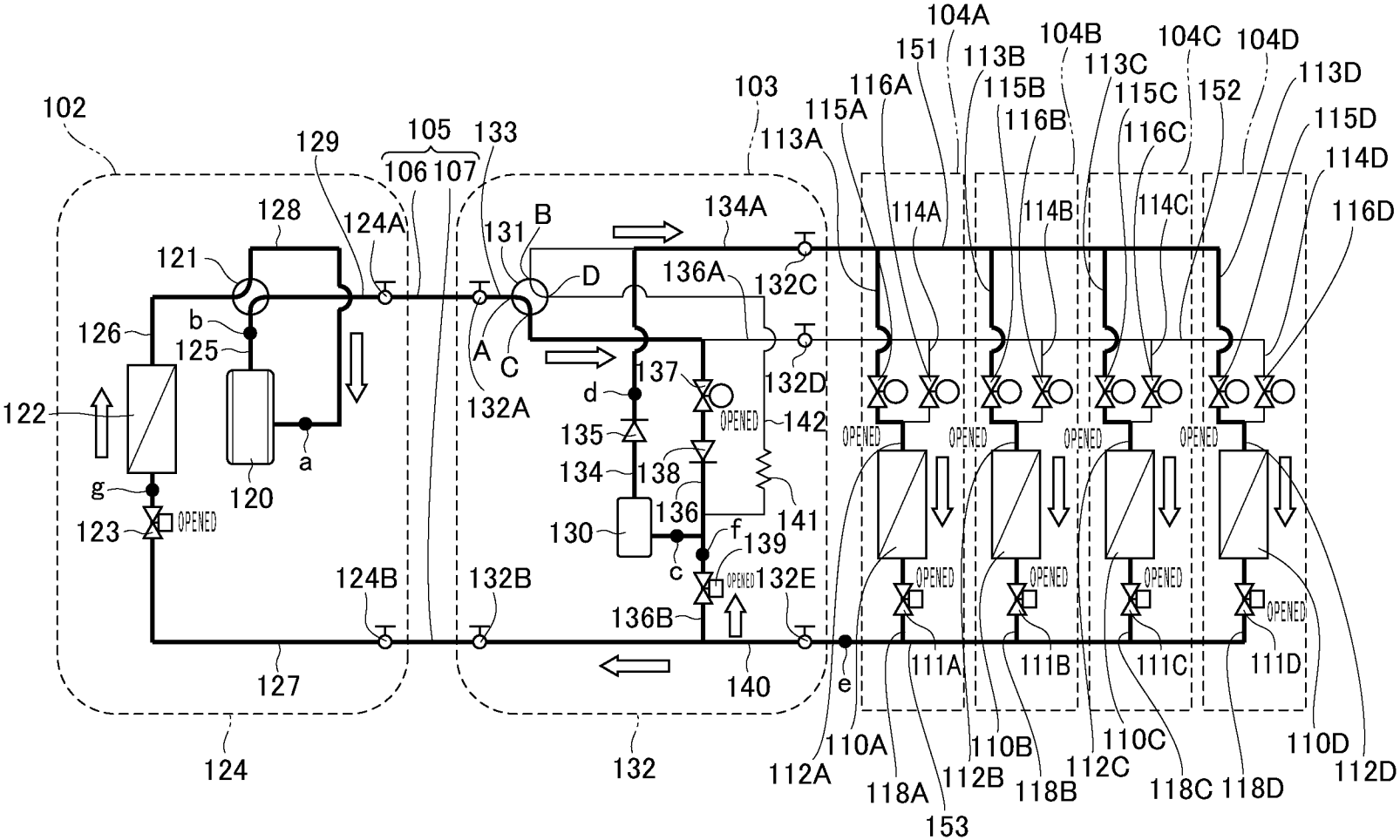
FIG. 7 is a circuit diagram illustrating the flow of the refrigerant when the air conditioner performs the heating operation at an extremely low temperature.
Figure 8:
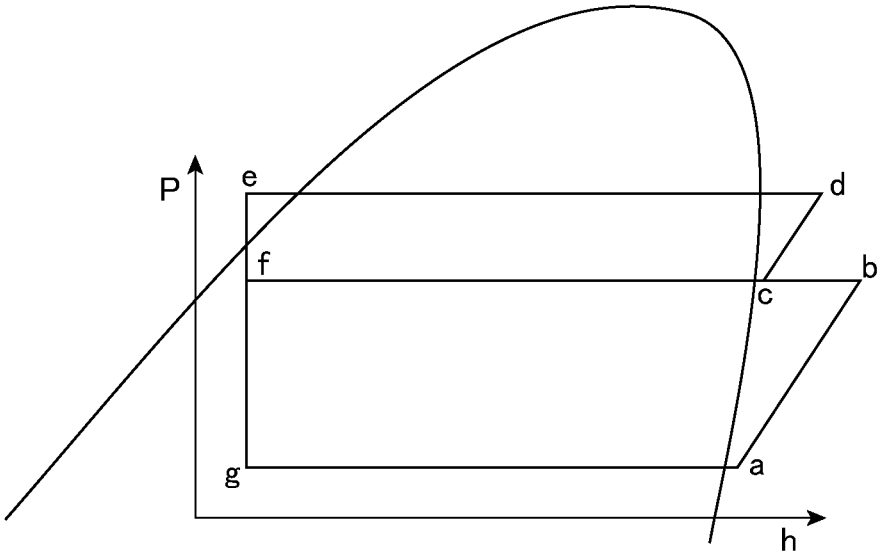
FIG. 8 is a P-h diagram illustrating a refrigerant cycle in FIG. 7.

FIG. 8 is a P-h diagram illustrating a refrigerant cycle in FIG. 7. In FIG. 8, points a to g indicate a relationship between a pressure and enthalpy at a position given the same reference numerals in FIG. 7.

In this configuration, since the discharged refrigerant compressed in the compressor 120 is compressed by the auxiliary compressor 130 of the switching unit 103 in two stages, condensing pressures (condensation temperatures) at the indoor heat exchangers 110A to 110D to which the discharged refrigerant of this auxiliary compressor 130 is supplied can be kept high, and even if the outside temperature is extremely low, the heating operation of the indoor units 104A to 104D can be performed. Also, in this case, since a part of the liquid refrigerant condensed in the indoor heat exchangers 110A to 110D is returned to the sucking side of the auxiliary compressor 130 through the second refrigerant sucking branch pipe 136B and the opening-degree regulating valve 139, the sucked refrigerant temperature of the auxiliary compressor 130 can be lowered, and if the discharge pressure of the auxiliary compressor 130 is to be raised to a desired discharge pressure, excessive rise of the discharge temperature of the auxiliary compressor 130 can be prevented.

Figure 9:
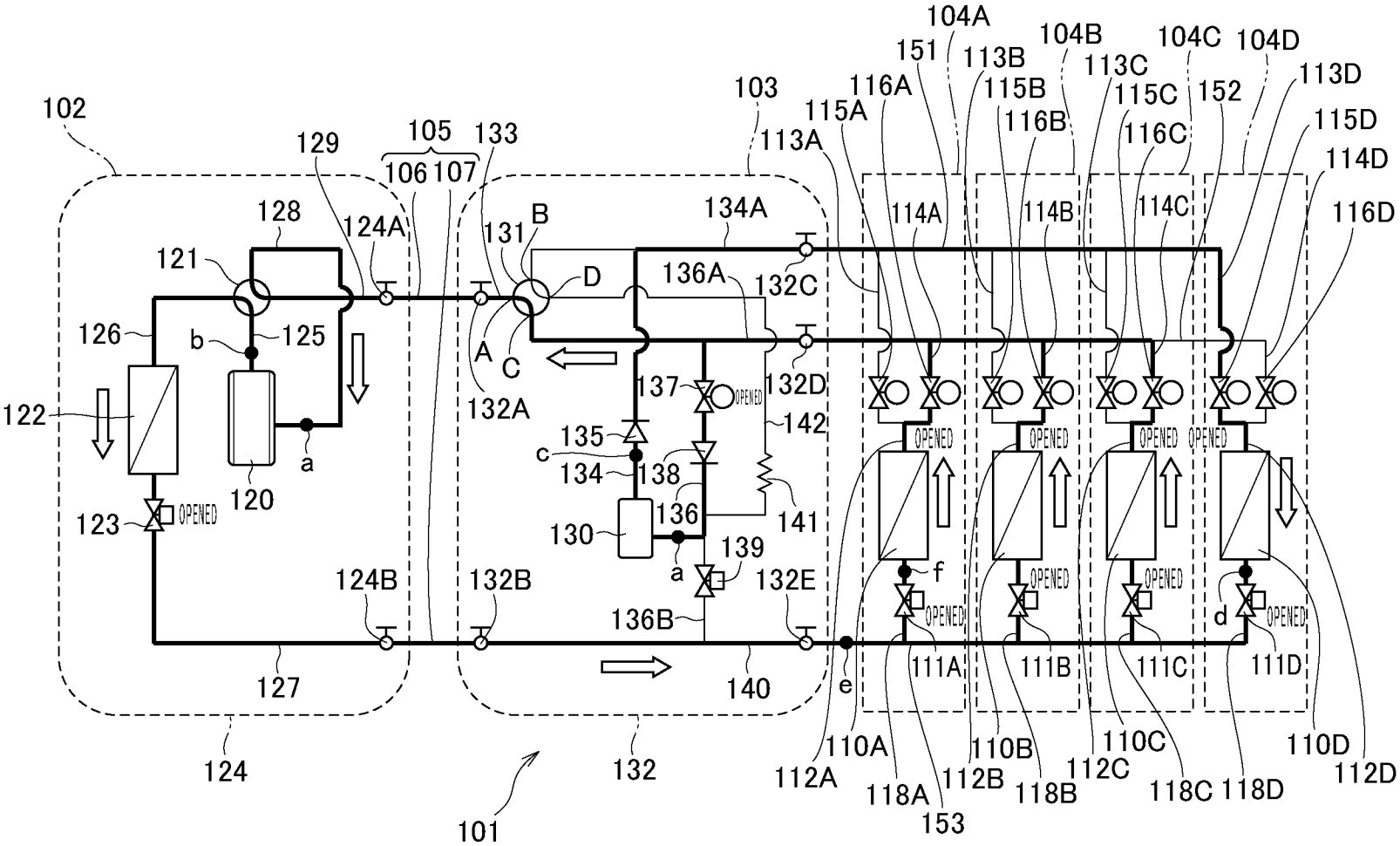
FIG. 9 is a circuit diagram illustrating the flow of the refrigerant when the air conditioner performs a mixed operation of cooling and heating with an emphasis on the cooling.

In the case of the cooling-heating mixed operation with an emphasis on the cooling of the indoor units 104A to 104D, if the indoor units 104A to 104C perform the cooling operation and the indoor unit 104D performs the heating operation, for example, as shown in FIG. 9, in the outdoor unit 102, the four-way valve 121 is switched to the position of the cooling operation where the discharged refrigerant of the compressor 120 is led to the outdoor heat exchanger 122, while in the indoor units 104A to 104C, the first opening/closing valves 115A to 115C are closed, the second opening/closing valves 116A to 116C are opened, and in the indoor unit 104D, the first opening/closing valve 115D is opened, and the second opening/closing valve 116D is closed.

Also, in the switching unit 103, the auxiliary compressor 130 is operated, the four-way valve 131 is switched to the first switching position, the electromagnetic opening/closing valve 137 is opened, and the opening-degree regulating valve 139 is closed.

As a result, the refrigerant discharged from the compressor 120 sequentially flows to the refrigerant discharge pipe 125, the four-way valve 121, the in-unit gas pipe 126, and the outdoor heat exchanger 122 and is condensed and liquefied in the outdoor heat exchanger 122 and then, flows into the fluid pipe 153 through the in-unit fluid pipe 127, the fluid pipe 107 of the inter-unit pipeline 105, and the in-unit fluid pipe 140 of the switching unit 103.

On the other hand, the refrigerant discharged from the auxiliary compressor 130 flows into the indoor unit 104D through the refrigerant discharge pipe 134, the refrigerant discharge branch pipe 134A, and the high-pressure gas pipe 151. The refrigerant having flown into the indoor unit 104D flows into the indoor heat exchanger 110D through the high-pressure gas branch pipe 113D and the first opening/closing valve 115D and is condensed and liquefied therein and then, flows into the fluid pipe 153 through the fluid branch pipe 118D and merges with the refrigerant discharged from the compressor 120 of the outdoor unit 102 in this fluid pipe 153.

The liquid refrigerant flowing through the fluid pipe 153 is distributed into the indoor expansion valves 111A to 111C of the indoor units 104A to 104C and is decompressed therein. Then, the decompressed refrigerant is evaporated and vaporized in each of the indoor heat exchangers 110A to 110C and then, flows into the switching unit 103 through the second opening/closing valves 116A to 116C, the low-pressure gas branch pipes 114A to 114C, and the low-pressure gas pipe 152, respectively, and is distributed to two parts in the switching unit 103.

One of the refrigerants is sucked into the auxiliary compressor 130 through the first refrigerant sucking branch pipe 136A and the refrigerant sucking pipe 136. The other refrigerant flows into the outdoor unit 102 through the refrigerant sucking pipe 136, the four-way valve 131, and the gas pipe 106 and is sucked into the compressor 120 through the in-unit gas pipe 129, the four-way valve 121, and the refrigerant sucking pipe 128. As mentioned above, the indoor units 104A to 104C are cooled by the indoor heat exchangers 110A to 110C working as evaporators, respectively, and the indoor unit 104D is heated by the other indoor heat exchanger 110D working as a condenser.

Figure 10:
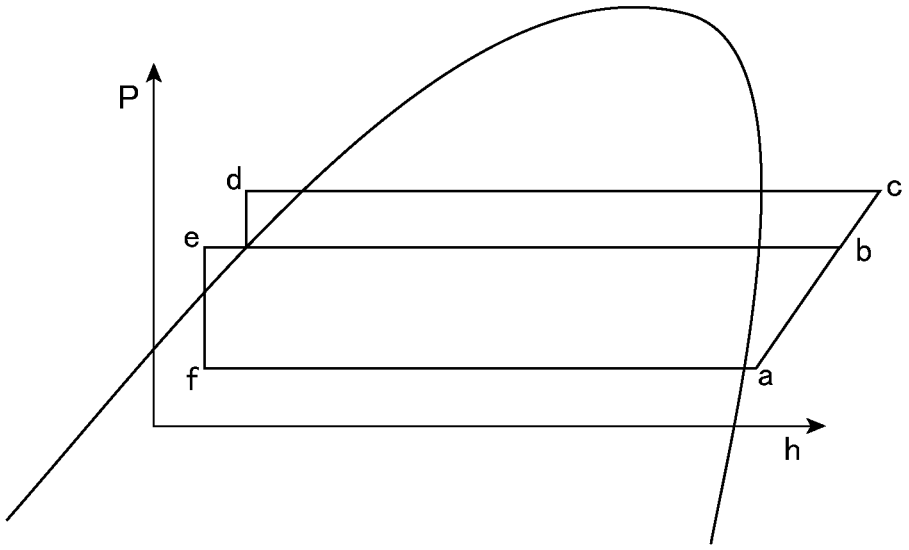
FIG. 10 is a P-h diagram illustrating a refrigerant cycle in FIG. 9.

FIG. 10 is a P-h diagram illustrating a refrigerant cycle in FIG. 9. In general, in the case of the cooling-heating mixed operation with an emphasis on the cooling operation of the indoor units, since the outside temperature is lower than in the summer during which the indoor units perform the cooling operation at the same time, the condensation temperature in the refrigerant cycle can be lowered by a portion of the outside temperature drop.

However, in the prior-art triple-pipeline type air conditioner, since the outdoor heat exchanger of the outdoor unit communicates with the indoor heat exchanger of the indoor unit through the high-pressure gas pipe, in order to perform the heating operation by the indoor heat exchanger, the condensation temperature at the outdoor heat exchanger, that is, the discharge pressure (high pressure) of the compressor should be raised than the outside temperature.

On the other hand, in this configuration, the switching unit 103 is arranged between the outdoor unit 102 and the indoor units 104A to 104D, and the refrigerant discharge pipe 125 of the compressor 120 is separated from the refrigerant discharge pipe 134 of the auxiliary compressor 130 by the four-way valve 131 of the switching unit 103. Therefore, as shown in FIG. 10, as compared with the discharge pressure (c-d in FIG. 10) of the auxiliary compressor 130 that contributes to the heating operation of the indoor unit 104D, the discharge pressure (a-f in FIG. 10) of the compressor 120 can be kept low, and a work load (power consumption) of the compressor 120 can be reduced.

Also, in this embodiment, since the auxiliary compressor 130 is provided with the capacity of approximately half of the compressor 120, if the cooling load and the heating load of the indoor units 104A to 104D are balanced with each other (50:50), for example, the operation of the compressor 120 can be stopped so as to perform the air-conditioning operation only by the auxiliary compressor 130, and the power consumption of the air conditioner 101 can be reduced.

Figure 11:
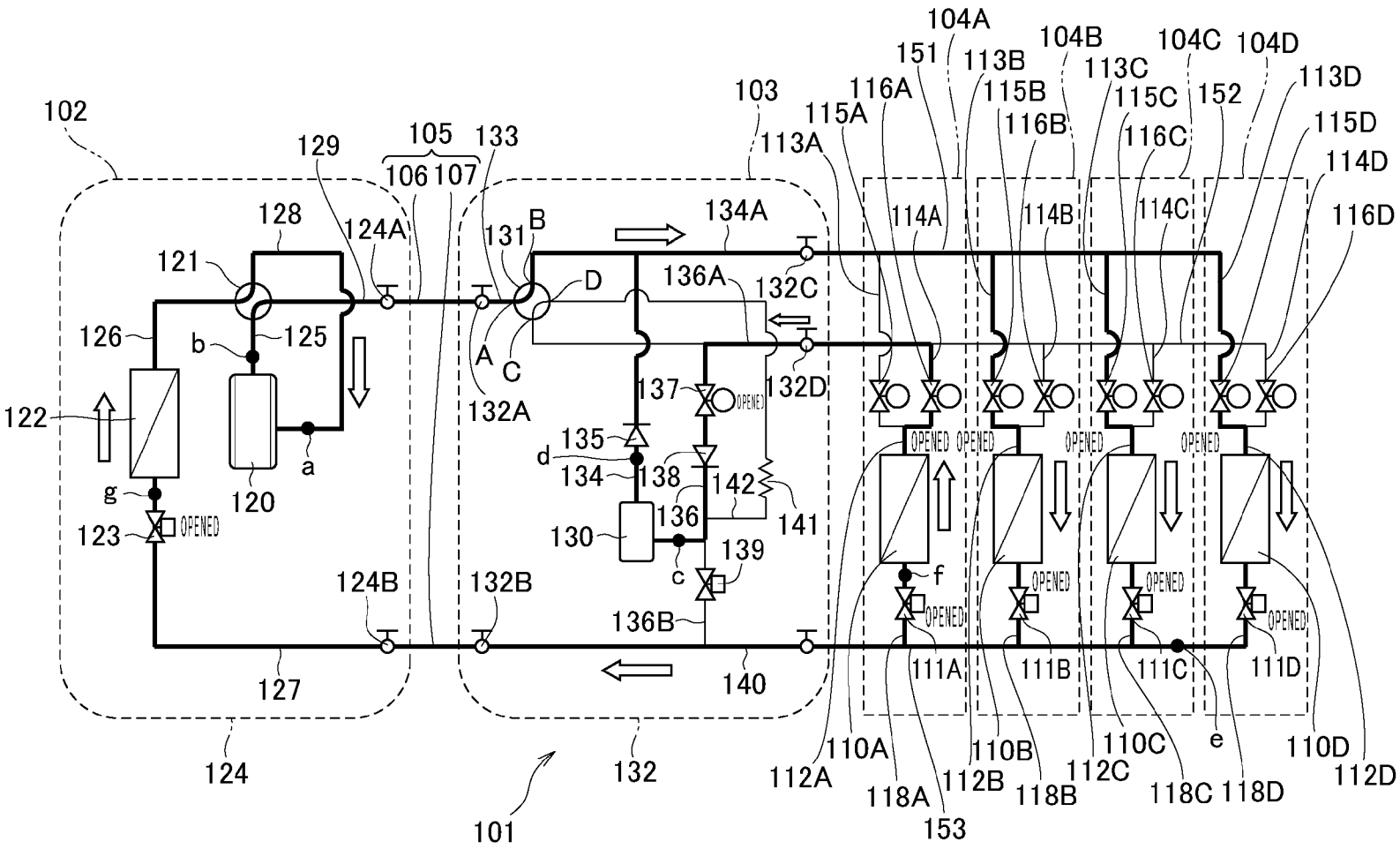
FIG. 11 is a circuit diagram illustrating the flow of the refrigerant when the air conditioner performs a mixed operation of cooling and heating with an emphasis on the heating.

In the case of the cooling-heating mixed operation on an emphasis on the heating of the indoor units 104A to 104D, if the indoor unit 104A performs the cooling operation and the indoor units 104B to 104D perform the heating operation, as shown in FIG. 11, in the outdoor unit 102, the four-way valve 121 is switched to the position of the heating operation where the discharged refrigerant of the compressor 120 is led to the gas pipe 106, while in the indoor unit 104A, the first opening/closing valve 115A is closed, the second opening/closing valve 116A is opened, and in the indoor units 104B to 104D, the first opening/closing valves 115B to 115D are opened, and the second opening/closing valves 116B to 116D are closed.

Also, in the switching unit 103, the auxiliary compressor 130 is operated, and the four-way valve 131 is switched to the second switching position where the gas pipe 106 of the inter-unit pipeline 105 and the refrigerant discharge pipe 134 of the auxiliary compressor 130 communicate with each other, the electromagnetic opening/closing valve 137 is opened, and the opening-degree regulating valve 139 is closed.

As a result, the refrigerant discharged from the compressor 120 flows into the gas pipe 106 of the inter-unit pipeline 105 through the refrigerant discharge pipe 125, the four-way valve 121, and the in-unit gas pipe 129. The gas refrigerant flowing through the gas pipe 106 flows into the in-unit gas pipe 133, the four-way valve 131, and the refrigerant discharge pipe 134 of the switching unit 103.

On the other hand, the refrigerant discharged from the auxiliary compressor 130 flows into the refrigerant discharge pipe 134 and merges with the refrigerant discharged from the compressor 120 of the outdoor unit 102 in the refrigerant discharge pipe 134. The merged refrigerant is distributed to the high-pressure gas branch pipes 113B to 113D of each of the indoor units 104B to 104D through the refrigerant discharge branch pipe 134A and the high-pressure gas pipe 151 and then, flows into the first opening/closing valves 115B to 115D and the indoor heat exchangers 110B to 110D and is condensed and liquefied therein, respectively. The liquefied liquid refrigerant flows into the fluid pipe 153 through the fluid branch pipes 118B to 118D.

A part of the liquid refrigerant having flown into the fluid pipe 153 flows into the indoor unit 104A and is decompressed by the indoor expansion valve 111A in the indoor unit 104A and the decompressed refrigerant is evaporated and vaporized by the indoor heat exchanger 110A. Then, the vaporized gas refrigerant flows into the switching unit 103 through the second opening/closing valve 116A, the low-pressure gas branch pipe 114A, and the low-pressure gas pipe 152 and is sucked into the auxiliary compressor 130 through the first refrigerant sucking branch pipe 136A and the refrigerant sucking pipe 136.

On the other hand, the remaining liquid refrigerant having flown into the fluid pipe 153 flows into the outdoor unit 102 through the in-unit fluid pipe 140 of the switching unit 103, reaches the in-unit fluid pipe 127 and the outdoor expansion valve 123 of the outdoor unit 102, and is decompressed therein. The decompressed refrigerant is evaporated and vaporized by the outdoor heat exchanger 122 and then, is sucked into the compressor 120 through the in-unit gas pipe 126, the four-way valve 121, and the refrigerant sucking pipe 128. As mentioned above, the indoor unit 104A is cooled by the indoor heat exchanger 110A working as an evaporator, while the indoor units 104B to 104D are heated by the other indoor heat exchangers 110B to 110D working as condensers.

Figure 12:
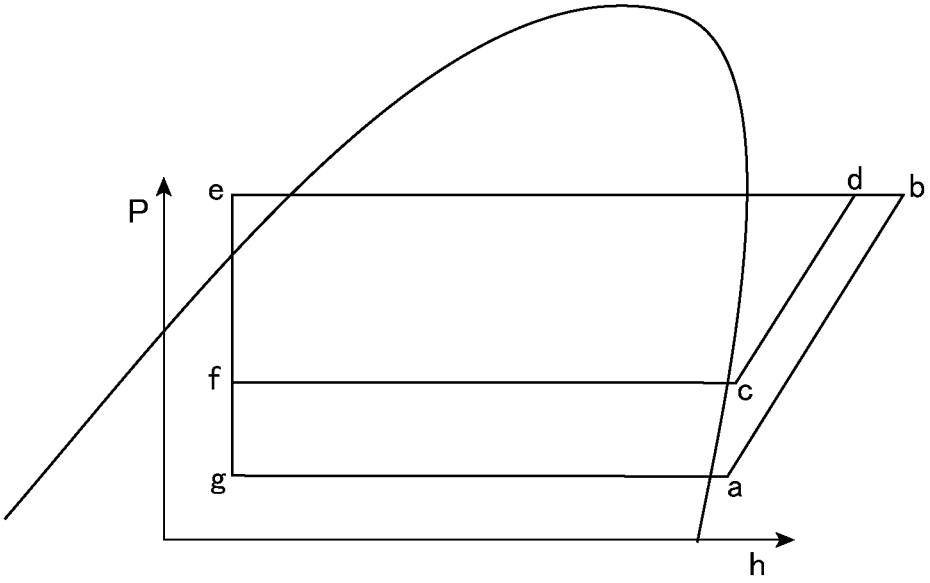
FIG. 12 is a P-h diagram illustrating a refrigerant cycle in FIG. 11.

FIG. 12 is a P-h diagram illustrating a refrigerant cycle in FIG. 11.

In general, in the case of the cooling operation in the season at a low outside temperature as in the winter, in the outdoor heat exchanger, the evaporation temperature needs to be lowered in order to take in heat from the outside air at a low temperature. In the prior-art triple-pipeline type air conditioner, since the outdoor heat exchanger of the outdoor unit and the indoor heat exchanger of the indoor unit communicate with each other through the low-pressure gas pipe, the evaporation temperature in the indoor heat exchanger is lowered, the operation efficiency is deteriorated, and the indoor heat exchanger is frozen, and thus, the cooling operation should be interrupted in some cases.

On the other hand, in this configuration, the switching unit 103 is arranged between the outdoor unit 102 and the indoor units 104A to 104D, and the refrigerant sucking pipe 128 of the compressor is separated from the refrigerant sucking pipe 136 of the auxiliary compressor 130 by the four-way valve 131 of the switching unit 103. Therefore, as shown in FIG. 12, the evaporation temperature at the indoor heat exchanger 110A (evaporation pressure: f-c in FIG. 12) when the indoor unit 104A performs the cooling operation can be set higher than the evaporation temperature (evaporation pressure: g-a in FIG. 12) at the outdoor heat exchanger 122, and the cooling operation of the indoor unit 104A can be performed efficiently.

Also, in this embodiment, since the auxiliary compressor 130 is provided with the capacity of approximately a half of the compressor 120, if the cooling loads and the heating loads of the indoor units 104A to 104D are balanced (50:50), for example, since the operation of the compressor 120 can be stopped and the air-conditioning operation can be performed only by the auxiliary compressor 130, power consumption of the air conditioner 101 can be reduced.

As described above, according to this embodiment, the outdoor unit 102 provided with the compressor 120, the four-way valve 121, and the outdoor heat exchanger 122, the switching unit 103 provided with the four-way valve 131 that is connected to the two inter-unit pipelines 105 of the gas pipe 106 and the fluid pipe 107 extending from the outdoor unit 102 and that selectively branches and connects the gas pipe 106 to the high-pressure gas pipe 151 and the low-pressure gas pipe 152 and with the auxiliary compressor 130 having the refrigerant sucking pipe 136 connected to the low-pressure gas pipe 152 and the refrigerant discharge pipe 134 connected to the high-pressure gas pipe 151, and the plurality of indoor units 104A to 104D provided with the indoor heat exchangers 110A to 110D having one ends selectively branching and connected to the high-pressure gas pipe 151 and the low-pressure gas pipe 152 and the other ends connected to the fluid pipe 107 through the fluid branch pipes 118A to 118D, and thus, the cooling operation and the heating operation of the indoor units 104A to 104D can be performed in a mixed manner using the so-called double-pipeline type outdoor unit 102.

Also, according to this embodiment, since the switching unit 103 is arranged close to the indoor units 104A to 104D, the air conditioner 101 can be constituted using the existing inter-unit pipeline 105 made up of the gas pipe 106 and the fluid pipe 107 as it is, and with the simple configuration in which the outdoor unit 102, the switching unit 103, and the indoor units 104A to 104D are connected to the existing inter-unit pipeline 105, the cooling operation or the heating operation of each of the indoor units 104A to 104D can be made possible or the cooling operation and the heating operation can be performed in a mixed manner.

Also, according to this embodiment, to the refrigerant sucking pipe 128 of the switching unit 103, one end of the second refrigerant sucking branch pipe 136B branching between the auxiliary compressor 130 and the four-way valve 131 is connected, while the other end of the second refrigerant sucking branch pipe 136B is connected to the in-unit fluid pipe 140 through the opening-degree regulating valve 139, and thus, during the heating operation of the indoor units 104A to 104D, by switching the four-way valve 131 to the first switching position and by opening the opening-degree regulating valve 139, a part of the liquid refrigerant condensed in the indoor heat exchangers 110A to 110D of the indoor units 104A to 104D can be made to be mixed with the refrigerant discharged from the compressor 120 of the outdoor unit 102 and to be sucked into the auxiliary compressor 130. Thus, by compressing the discharged refrigerant compressed by the compressor 120 by the auxiliary compressor 130 of the switching unit 103 in two stages, the condensation pressure (condensation temperature) in the indoor heat exchangers 110A to 110D to which the discharged refrigerant of the auxiliary compressor 130 is supplied can be maintained high, and even if the outside temperature is extremely low, the indoor units 104A to 104D can perform the heating operation.

Also, according to this embodiment, since the auxiliary compressor 130 of the switching unit 103 is provided with the capacity of at least a half of the compressor 120 of the outdoor unit 102, if the cooling-heating mixed operation is performed with the load balance of the cooling load and the heating load of 50%:50%, for example, the cooling and the heating operations of each of the indoor units 104A to 104D can be performed using only the auxiliary compressor 130, and thus, the operation of the outdoor unit 102 can be stopped. Also, if the cooling load or the heating load is increased and the load balance of the cooling load and the heating load is changed to 60%:40%, for example, the excess cooling load can be borne by the outdoor unit 102. Thus, however changed the load balance of the cooling load and the heating load of the indoor units 104A to 104D during the cooling-heating mixed operation is, the air-conditioning operation with the load balance can be realized.

Also, according to this embodiment, if the cooling-heating mixed operation with an emphasis on the cooling is performed by the indoor units 104A to 104D, the four-way valve 131 shuts off the communication between the refrigerant discharge pipe 125 of the compressor 120 in the outdoor unit 102 and the refrigerant discharge pipe 134 of the auxiliary compressor 130 in the switching unit 103, and thus, the discharge pressure of the compressor 120 can be kept lower than the discharge pressure of the auxiliary compressor 130 supplied to the indoor unit 104D that performs the heating operation, and the work load (power consumption) of the compressor 120 can be reduced.

The present invention has been described above on the basis of the embodiment, but the present invention is not limited to that. For example, in this embodiment, the switching unit 103 is configured to be provided with the four-way valve 131 as a switching valve, but not limited to that, and it may be so configured that an electromagnetic opening/closing valve can be combined instead of the four-way valve 131. Also, the switching unit 103 is configured to contain the four-way valve 131 in the unit case 132, but this four-way valve 131 may be disposed outside the unit case 132.

The invention claimed is:

1. An air conditioner comprising:

a first outdoor unit provided with a first compressor, a first outdoor heat exchanger, and a first outdoor expansion valve; and a plurality of indoor units connected to the first outdoor unit by an inter-unit pipeline and provided with indoor heat exchangers, one end of the first outdoor heat exchanger selectively branched and connected to a refrigerant discharge pipe and a refrigerant sucking pipe of the first compressor, the inter-unit pipeline including a high-pressure gas pipe connected to the refrigerant discharge pipe, a low-pressure gas pipe connected to the refrigerant sucking pipe, and a fluid pipe connected to the other end of the first outdoor heat exchanger, one end of the indoor heat exchanger being selectively branched and connected to the high-pressure gas pipe and the low-pressure gas pipe, and the other end of the indoor heat exchanger being connected to the fluid pipe through a fluid branch pipe so that the plurality of the indoor units can perform a cooling operation or a heating operation at the same time or the cooling operation and the heating operation can be performed in a mixed manner, wherein a second outdoor unit provided with a second compressor, a second outdoor heat exchanger, and a second outdoor expansion valve and connected by two pipelines of a gas pipe and a fluid pipe and a valve-element kit having a channel switching valve that connects the fluid pipe of the second outdoor unit to the fluid pipe of the inter-unit pipeline and selectively connects the gas pipe of the second outdoor unit to the high-pressure gas pipe or the low-pressure gas pipe of the inter-unit pipeline are provided, the first outdoor unit is provided with a first outdoor unit valve element that makes the refrigerant discharge pipe and the high-pressure gas pipe capable of communicating with each other, each of the plurality of indoor units comprises a high-pressure gas branch pipe connected to the high-pressure gas pipe through a first indoor unit valve and a low-pressure gas branch pipe connected to the low-pressure gas pipe through a second indoor unit valve, and in a case of the cooling operation of the plurality of indoor units at the same time, a controller is configured to control the first outdoor unit valve element to shut off communication between the refrigerant discharge pipe of the first compressor and the high-pressure gas pipe, control the plurality of indoor units to close the first indoor unit valve and open the second indoor unit valve in a part of the plurality of indoor units while to open the first indoor unit valve and close the second indoor unit valve in the remaining plurality of indoor units, and switch the channel switching valve to connect the gas pipe of the second outdoor unit to the high-pressure gas pipe.

2. The air conditioner according to claim 1, wherein the first outdoor unit valve element is a single first four-way valve having four ports, in which the refrigerant discharge pipe is connected to a first port of this first four-way valve, the high-pressure gas pipe is connected to a second port, a third port is closed or the low-pressure gas pipe is connected to this third port through a capillary tube, and a fourth port is closed or the low-pressure gas pipe is connected to this fourth port through a capillary tube.

3. The air conditioner according to claim 1, wherein the first outdoor unit is provided with a second four-way valve between the first compressor and the first outdoor heat exchanger, the high-pressure gas pipe is connected through the first outdoor unit valve element to a refrigerant discharge branch pipe branching from between this second four-way valve and the first compressor, and the low-pressure gas pipe is connected to a refrigerant sucking branch pipe branching from between the second four-way valve and the first compressor; and the second four-way valve makes the low-pressure gas pipe communicate with the first outdoor heat exchanger at a first switching position and makes the first compressor communicate with the first outdoor heat exchanger at a second switching position.

4. The air conditioner according to claim 1, wherein the valve-element kit is provided with a single third four-way valve as the channel switching valve, in which the gas pipe is connected to a first port of this third four-way valve, the low-pressure gas pipe is connected to a second port, the high-pressure gas pipe is connected to a third port, and a fourth port is closed or the low-pressure gas pipe is connected to this fourth port through a capillary tube.

5. The air conditioner according to claim 1, wherein the valve-element kit is disposed outside of a housing of the second outdoor unit.

6. The air conditioner according to claim 1, wherein the capacity of the first compressor is configured to be provided with the capacity of at least a half of all the compressors disposed in the air conditioner.

* * * * *